US009643687B2

(12) United States Patent
Gilbert et al.

(10) Patent No.: US 9,643,687 B2
(45) Date of Patent: May 9, 2017

(54) SELF-INSTALLING ANCHOR

(71) Applicant: Board of Regents, The University of Texas System, Austin, TX (US)

(72) Inventors: Robert B. Gilbert, Austin, TX (US); Jose Eugenio Iturriaga Flores, Austin, TX (US); Hande Gerkus, Austin, TX (US)

(73) Assignee: Board of Regents, The University of Texas System, Austin, TX (US)

( * ) Notice: Subject to any disclaimer, the term of this patent is extended or adjusted under 35 U.S.C. 154(b) by 0 days.

(21) Appl. No.: 15/061,399

(22) Filed: Mar. 4, 2016

(65) Prior Publication Data

US 2016/0257380 A1 Sep. 8, 2016

Related U.S. Application Data

(60) Provisional application No. 62/146,726, filed on Apr. 13, 2015, provisional application No. 62/128,577, filed on Mar. 5, 2015.

(51) Int. Cl.
*B63B 21/32* (2006.01)
*B63B 21/34* (2006.01)
(Continued)

(52) U.S. Cl.
CPC ..... *B63B 21/26* (2013.01); *B63B 21/38* (2013.01); *B63B 21/50* (2013.01)

(58) Field of Classification Search
CPC ..... B63B 2021/26; B63B 21/29; B63B 21/30; B63B 31/32; B63B 31/36; B63B 21/38;
(Continued)

(56) References Cited

U.S. PATENT DOCUMENTS 1,550,451 A 8/1925 Pardey
2,651,277 A * 9/1953 Jenshak ..... B63B 21/44 114/299
(Continued)

FOREIGN PATENT DOCUMENTS

| | | |
|---|---|---|
| GB | 18608 | 0/1905 |
| WO | 8300126 | 1/1983 |
| WO | 2013133695 | 9/2013 |

OTHER PUBLICATIONS

Department of Civil, Architectural, and Environmental Engineering, Cockrell School of Engineering, The University of Texas at Austin, "Developing a Green Offshore Foundation Concept," http://www.caee.utexas.edu, published Jul. 9, 2013, which is based on an interview with Hande Gerkus on Jun. 27, 2013.
(Continued)

*Primary Examiner* — Daniel V Venne
(74) *Attorney, Agent, or Firm* — Meunier Carlin & Curfman LLC

(57) ABSTRACT

The self-installing anchor is configured for falling vertically through the water, embedding vertically into the soil, rotating and translating diagonally deeper through the soil in response to the anchor line load being transmitted to it, and achieving its maximum holding capacity with the anchor line acting normal to the fluke. In various implementations, a coupling mechanism at one end of the shank is engaged with a bearing surface at an entry end of the fluke to hold the shank close to the fluke while falling through the water and embedding vertically into the soil. The coupling mechanism provides eccentricity to the load applied and allows for the rotation of the anchor. The coupling mechanism is disengaged at a predetermined angle, liberating one end of the shank, and the point of application of the force on the anchor is modified to make it dive deeper into the soil.

14 Claims, 20 Drawing Sheets

(51) Int. Cl.
*B63B 21/26* (2006.01)
*B63B 21/38* (2006.01)
*B63B 21/50* (2006.01)

(58) Field of Classification Search
CPC ... B63B 21/40; B63B 21/42; B63B 2021/262; B63B 2021/265
USPC ..... 114/295, 297, 299, 301, 304, 309, 310
See application file for complete search history.

(56) References Cited

U.S. PATENT DOCUMENTS 3,841,255 A * 10/1974 Mansfield ..... B63B 21/46 114/299
4,831,952 A 5/1989 Dulhunty
5,546,883 A 8/1996 van der Haak
5,855,181 A * 1/1999 Oxford ..... B63B 21/32 114/301
5,890,451 A 4/1999 Bruce
6,082,284 A * 7/2000 McCabe ..... B63B 21/26 114/301
2005/0257730 A1* 11/2005 Willis ..... B63B 21/32 114/298
2014/0079489 A1* 3/2014 Naquin, Jr. ..... E02D 5/80 405/224

OTHER PUBLICATIONS

Gilbert, Robert, "Green Foundation for Green Energy", Presentation at University of Rhode Island, Feb. 6, 2014.
Gilbert, Robert, "Opportunities for Innovation in Offshore Geotechnics," Presentation at Civil Engineering Research Association of Ireland, Aug. 28, 2014, Belfast, Ireland.
Iturriaga Flores, Jose Eugenio, "Flying Wing Anchor, from concept to design," presentation to the Geo-Institute at the University of Texas at Austin, Sep. 17, 2014.
International Search Report and Written Opinion, dated May 20, 2016, received in connection with International Patent Application No. PCT/US2016/020955.

* cited by examiner

SELF-INSTALLING ANCHOR

CROSS REFERENCE FOR RELATED APPLICATIONS

This application claims priority to U.S. Provisional Patent Application No. 62/128,577 entitled "Self-Installing Anchor," filed Mar. 5, 2015, and U.S. Provisional Patent Application No. 62/146,726 entitled "Self-Installing Anchor," filed Apr. 13, 2015, the contents of which are herein incorporated by reference in their entireties.

GOVERNMENT LICENSE RIGHTS

This invention was made with government support under NSF #CMMI-1301211 project awarded by U.S. National Science Foundation. The government has certain rights in the invention.

BACKGROUND

Offshore facilities generate nearly a third of the energy used in the U.S., and they have the potential to provide significantly more energy both with oil and gas and with renewable sources including wind, wave, current and thermal energy. The challenge in the future will be to produce this energy at a minimal cost and with minimal impact to the environment. Conventional anchors for offshore facilities are not very efficient, essentially requiring that a load near their desired capacity be applied during installation at considerable expense and environmental impact, when in service, it is unlikely that the anchor will ever experience a load that large. Additionally, the installation of conventional anchors generally requires multiple construction, support, and surveying vessels to be accomplished.

Accordingly, an improved anchor is needed that overcomes the disadvantages of conventional anchors.

BRIEF SUMMARY

Various implementations of a self-installing anchor are configured for falling vertically through the water, embedding vertically into the soil, rotating and translating diagonally deeper through the soil in response to the anchor line load being transmitted to it, and achieving its maximum holding capacity with the anchor line acting normal to the fluke. In various implementations, a coupling mechanism at one end of the shank is engaged with a bearing surface at an entry end of the fluke to hold the shank close to the fluke while falling through the water and embedding vertically into the soil. The coupling mechanism provides eccentricity to the load applied and allows for the rotation of the anchor. The coupling mechanism is disengaged at a predetermined angle, liberating one end of the shank, and the point of application of the force on the anchor is modified to make it dive deeper into the soil.

In particular, various implementations of the anchor include a shank, a fluke, a bearing surface, and a coupling mechanism. The shank has first and second ends. The fluke has an entry end, a trailing end, and a central portion intermediate the entry and trailing ends. The bearing surface is disposed adjacent the entry end of the fluke. The coupling mechanism is disposed adjacent the second end of the shank. The coupling mechanism is configured for: (1) engaging the bearing surface of the fluke during passage of the anchor through water and while embedding vertically into the soil, (2) transmitting the force applied by the anchor line to the front of the fluke causing the anchor to pitch, and (3) disengaging the bearing surface when a threshold angle between the force applied by the anchor line and the fluke is attained causing the anchor to translate near parallel to the fluke. A first end of the shank is rotatably coupled adjacent the central area of the fluke. When the coupling mechanism is engaged with the bearing surface, a center of mass of the anchor is below a center of drag and a center of lift of the anchor to keep the anchor vertically oriented such that the entry end of the fluke is vertically below and aligned with the trailing end of the fluke while passing through water. And, a weight of the anchor urges the anchor through the water and into soil below the water. The center of mass refers to the point on the anchor through which the force of gravity acts and is obtained by finding the location about which the sum of the moments due to the masses of the individual components of the anchor is equal to zero. The center of mass can be calculated based on the geometry of the anchor or measured with a scale. The center of lift refers to the point on the anchor through which the force of lift acts as the anchor is moving through a fluid. The center of lift is obtained by finding the location about which the sum of the moments due to the lift forces on individual components of the anchor is equal to zero. The center of lift can be calculated approximately by dividing the anchor up into sets of rectangular plates or measured in a flow test. The center of drag refers to the point on the anchor through which the force of drag acts as the anchor is moving through a fluid. The center of drag is obtained by finding the location about which the sum of the moments due to the drag forces on individual components of the anchor is equal to zero. The center of drag can be calculated approximately by dividing the anchor up into sets of rectangular plates or measured in a flow test.

In some implementations, at least a portion of the fluke is diamond shaped. For example, the diamond shaped portion of the fluke may be adjacent the trailing end. The fluke may also include a planar base and T-shaped protrusions that extend from a front face and a rear face of the base as viewed from the trailing end of the fluke. In certain implementations, the trailing end of the fluke is triangular-shaped.

In other implementations, the fluke may include first and second wings. The first wing is adjacent the trailing end of the fluke, and the second wing is disposed between the trailing end and the entry end of the fluke. The second wing may have a rectangular cross sectional shape as viewed from a front or a rear surface of the fluke and an airfoil cross-sectional shape as viewed from a side surface of the fluke. The first wing may also have a rectangular cross-sectional shape as viewed from the front or rear surface of the fluke. Further, in some implementations, the first wing may have a hexagonally shaped cross-section as viewed from the side of the fluke.

In some implementations, a protrusion extends outwardly from the front face of the fluke. A proximal end of the protrusion is disposed adjacent the front face of the entry end of the fluke, and the bearing surface comprises a surface of the protrusion that faces the entry end of the fluke. The coupling mechanism includes two arms spaced apart from each other disposed at the second end of the shank and a pin. Each of the two arms defines an elongated slot there through, and the elongated slots are aligned with each other along a first axis that extends perpendicularly through the arms and a second axis that extends through each end of the shank. The slots have the same slot width and length. The pin is disposed between the two arms and extends through the elongated slots. The pin is configured to move through the slots along the second axis. A central portion of the pin engages the bearing surface to hold the second axis adjacent a third axis that extends through each end of the fluke when the pin is disposed at proximal ends of the elongated slots, and the central portion of the pin disengages the bearing surface when the pin is disposed at distal ends of the elongated slots, allowing the second axis of the shank to rotate about the second end of the shank relative to the third axis of the fluke.

In certain implementations, the central portion of the pin includes a spool that extends radially outwardly from an axis of the pin that extends through the ends of the pin. The spool is configured for rotating freely around the axis of the pin. In addition, ends of a U-shaped hook may be coupled to the pin adjacent each end of the spool. A link may be coupled to the U-shaped hook, and the link is for coupling to the anchor line.

In other implementations, the ends of the U-shaped hook may be coupled to the pin adjacent a central portion of the pin. A link may be coupled to the U-shaped hook that is configured for coupling with a line that extends between the anchor and the vessel.

Furthermore, in certain implementations, the first end of the shank comprises first and second arms that are spaced apart from each other and are each rotatably coupled to the central portion of the fluke.

BRIEF DESCRIPTION OF THE DRAWINGS

The components in the drawings are not necessarily to scale relative to each other and like reference numerals designate corresponding parts throughout the several views.

DETAILED DESCRIPTION

Figure 1:
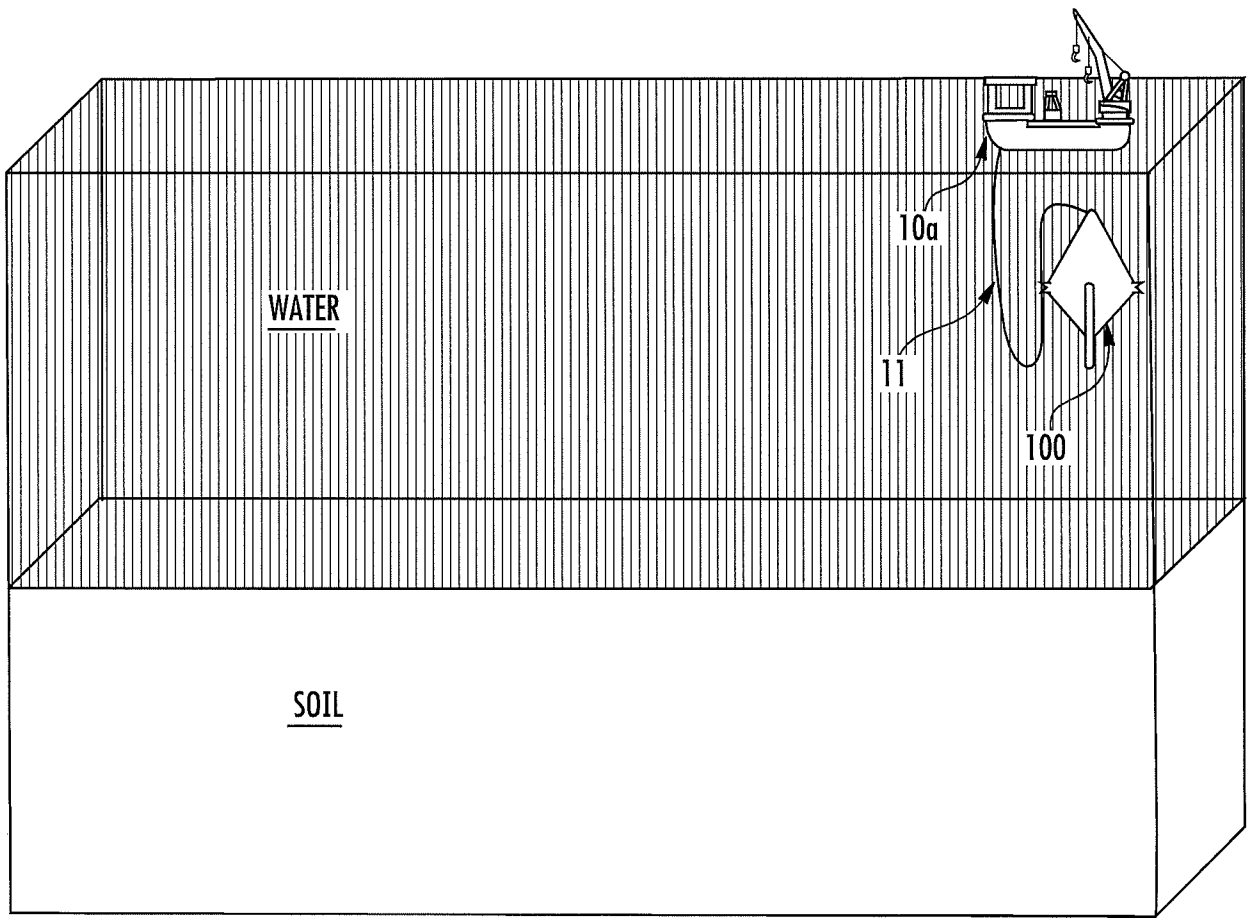
FIG. 1 is a front view of an anchor after being dropped into a body of water from an installation vessel on the surface of the water to which the anchor is coupled via an anchor line.

According to various implementations, an anchor includes a low-profile, high-bearing-area fluke and a shank. A first end of the shank is rotatably coupled to a central portion of the fluke, and a second end of the shank includes a coupling mechanism for engaging and disengaging with a bearing surface that extends outwardly from an entry end of the fluke. To install the anchor, the coupling mechanism is engaged against the bearing surface, which holds the shank close to the fluke, and an anchor line is coupled between the coupling mechanism and the vessel. The anchor is dropped through the water from a vessel, such that the entry end of the fluke is below a trailing end of the fluke. The center of mass of the anchor, where the force of gravity is applied, is below the center of drag and the center of lift, which allows the anchor to maintain a vertical orientation as it passes through the water, and recover the verticality in case of any perturbation. During the free fall through the water column, the anchor gets minimal or no resistance from the anchor line, which is reeled out, to allow the anchor to gain speed. After the anchor embeds into the soil below the water due to the kinetic energy with which it has reached the soil, the anchor line is transferred from the installation vessel to the facility that is going to be anchored.

As the environmental and operational loads act on the moored vessel, the anchor line transfers the force first to the soil via friction and then to the anchor. When the force applied by the anchor line to the anchor reaches a certain threshold, the anchor begins to pitch within the soil. When the angle between the force and the anchor has reached a predetermined value, the coupling mechanism is disengaged and the shank is liberated from the entry end of the fluke and starts rotating without the fluke moving. When the shank has reached alignment with the force from the anchor line it no longer rotates and the force is again transmitted to the fluke, making it dive deeper into the soil. As the anchor is diving deeper into the soil, the anchor line is traversing more, which makes the shank rotate further away from the fluke and ultimately reach its final position where the force applied by the anchor line and the shank are almost perpendicular to the fluke and the maximum holding capacity of the anchor is attained.

The shape of the anchor, its weight, and its ability to maintain a vertical orientation while passing through the water allow the anchor to drop to the soil below the water and penetrate into the soil due to gravity and without any additional assistance. In various implementations, the anchor may provide an increased holding capacity compared to conventional anchors having the same weight, which reduces the cost, effort, time, energy, and environmental impact of installation. For example, the anchor may penetrate into the soil twice as far as conventional anchors having the same weight. In addition, conventional anchors may include several drawbacks that are overcome by various implementations of the anchor. In particular, conventional anchors may need to be pulled into place with a separate installation vessel; they may only work in one type of soil or they may require parts that have to be selected based on the type of soil expected; and the angle between the shank and the fluke may be fixed and/or may require adjustment for certain types of soils. In some conventional anchors in which the shank opens up relative to the fluke, the anchors require a mechanism such as a shear pin that breaks at a threshold load, and the shear pin is selected based on the type of soil expected.

FIGS. 1 through 10 illustrate various views of anchor 100 being installed. FIG. 1 illustrates the anchor 100 as it starts free falling through the water. It is coupled to installation vessel 10*a* by an anchor line 11. The anchor 100 gets minimal or no resistance from the anchor line 11, which may be reeled out, to allow the anchor 100 to gain speed.

Figure 2:
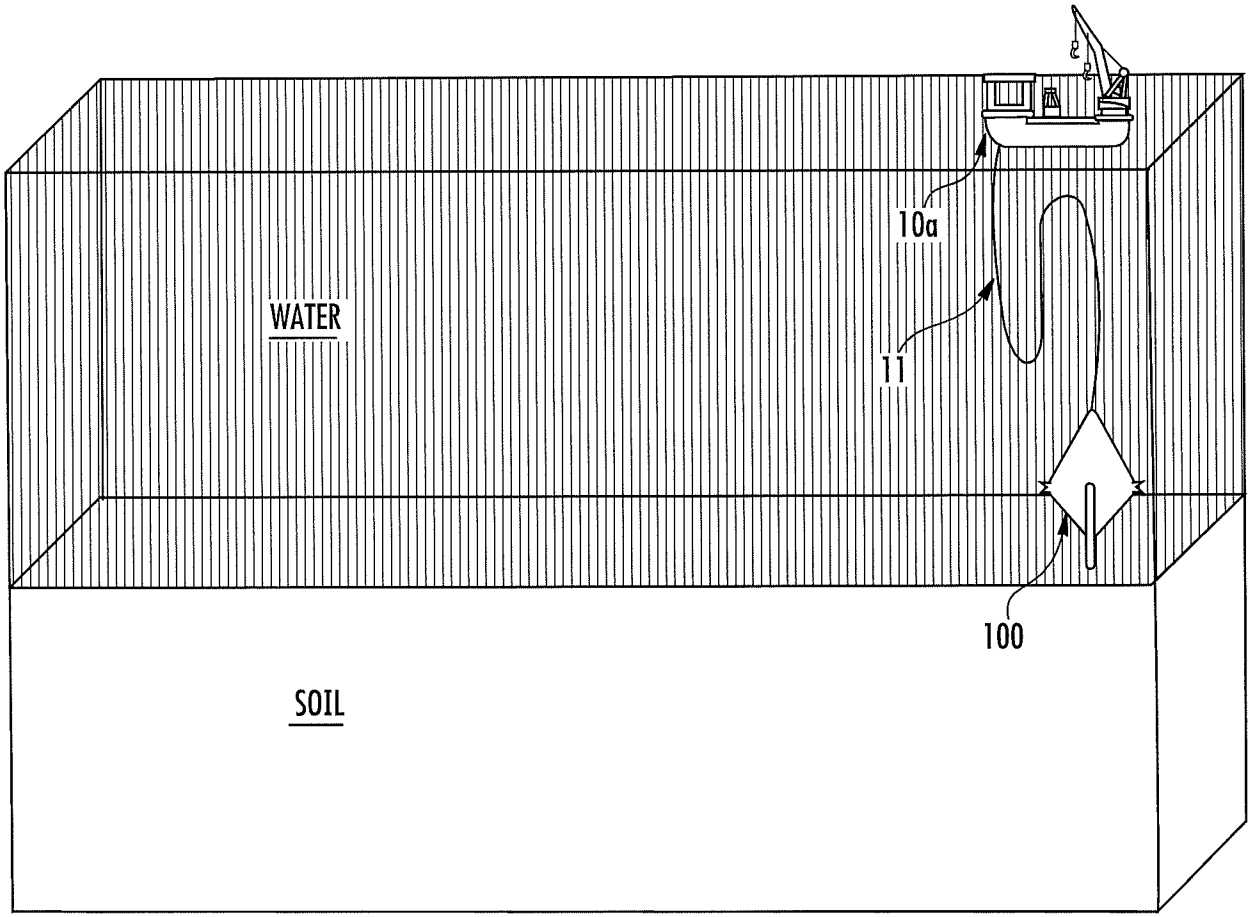
FIG. 2 is a front view of the anchor in FIG. 1 when the anchor reaches soil below the water.
Figure 3:
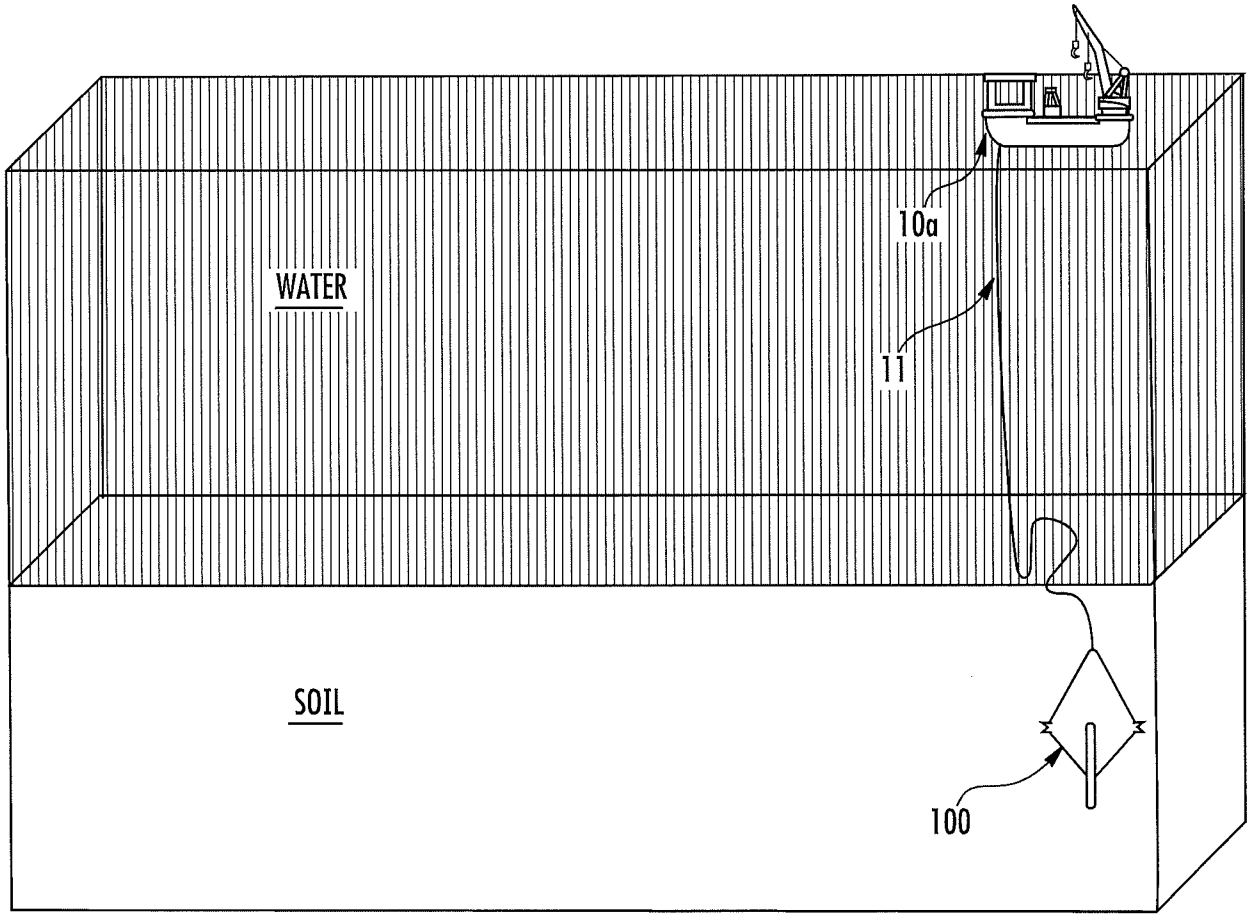
FIG. 3 is a front view of the anchor in FIG. 1 after it has penetrated the soil.
Figure 4:
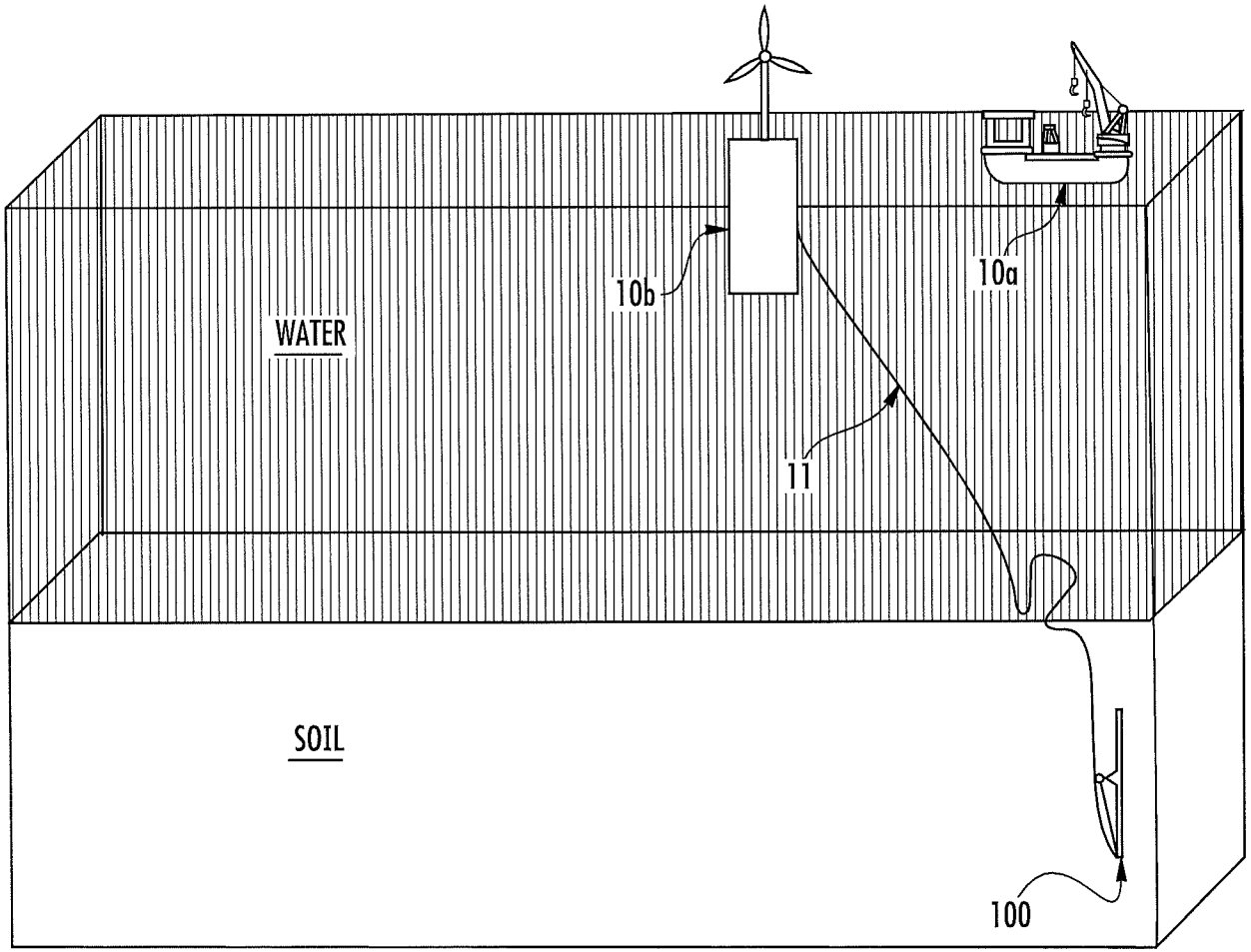
FIG. 4 is a side view of the anchor in FIG. 1 after the installation vessel transfers the anchor line to the facility that is going to be anchored.

FIG. 2 illustrates the anchor 100 when it reaches the soil below the water. The anchor 100 reaches the soil with considerable velocity due to the force of gravity, allowing it to embed vertically into the soil. FIG. 3 illustrates the anchor 100 after it has penetrated vertically through the soil due to the kinetic energy with which it has reached the bottom of the body of water. FIG. 4 illustrates the anchor line after it has been transferred from the installation vessel 10*a* to the floating facility 10*b* to be moored.

Figure 5:
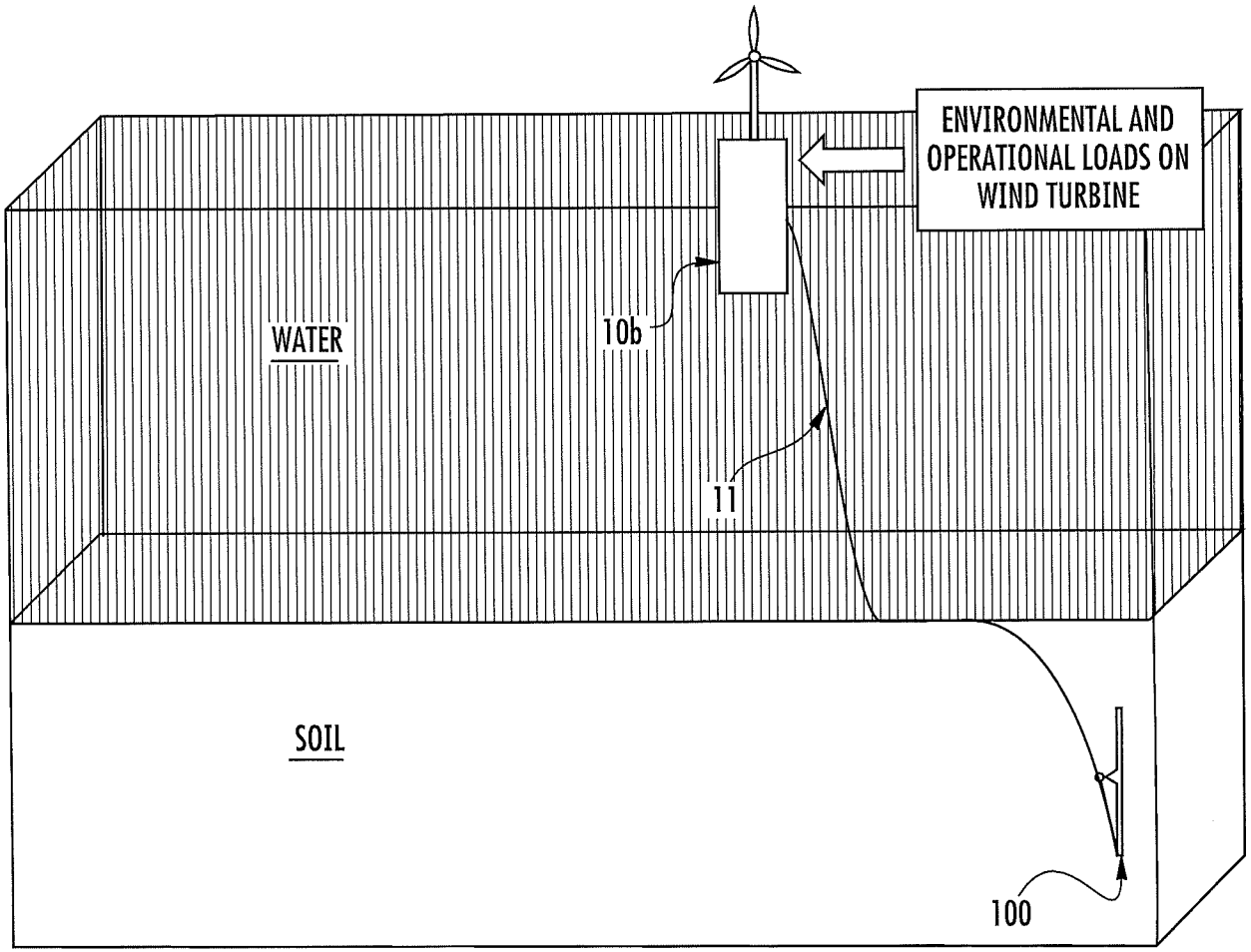
FIG. 5 is a side view of the anchor in FIG. 1 showing how the environmental and operational loads act on the moored vessel.
Figure 6:
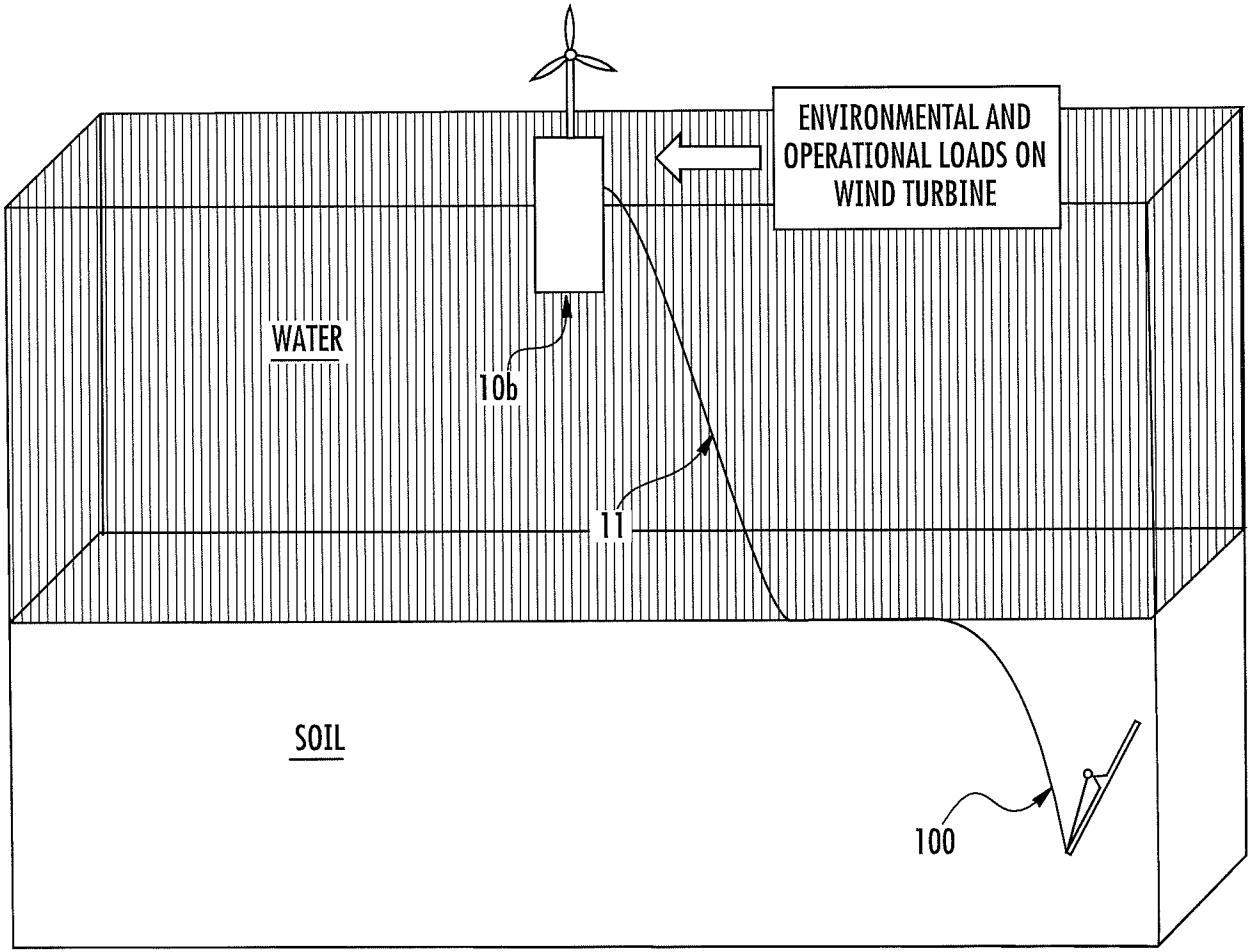
FIG. 6 is a side view of the anchor in FIG. 1 showing how, when the force applied by the anchor line reaches a certain threshold, the anchor begins to pitch within the soil.
Figure 7:
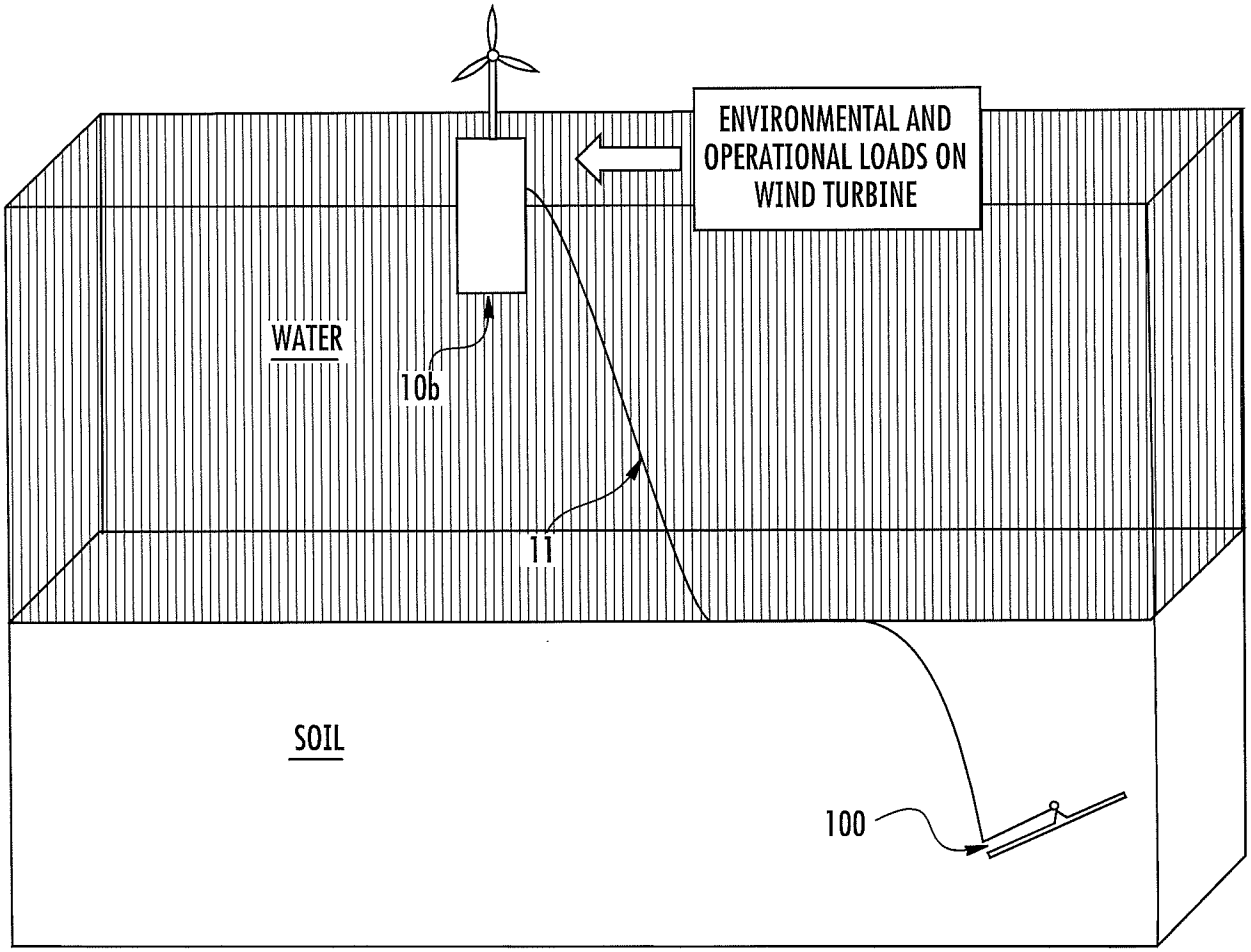
FIG. 7 is a side view of the anchor in FIG. 1 showing the coupling mechanism disengaged and the shank liberated, starting to rotate without the fluke moving.

FIG. 5 illustrates environmental and operational loads acting on the moored vessel 10*b*, causing the anchor line 11 to transfer the force first to the soil via friction and then to the anchor 100. FIG. 6 illustrates how, after the force applied to the anchor 100 by the anchor line 11 reaches a certain threshold magnitude, the anchor 100 begins to pitch within the soil. FIG. 7 illustrates the configuration at which the threshold angle between the force and the anchor 100 has been reached, the coupling mechanism is disengaged, and the shank is liberated and is starting to rotate without the fluke moving.

Figure 8:
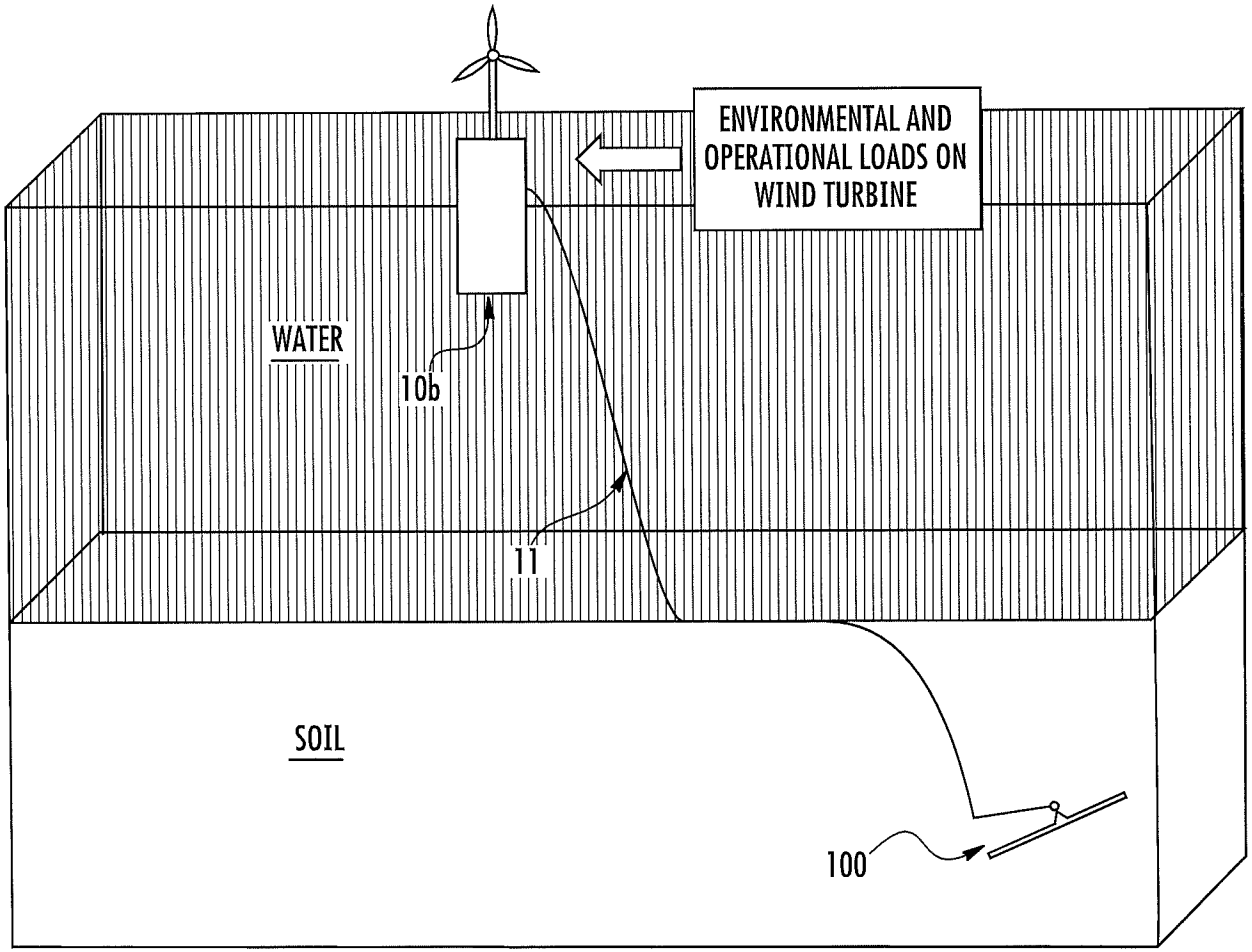
FIG. 8 is a side view of the anchor in FIG. 1 while the shank is rotating without the fluke moving.
Figure 9:
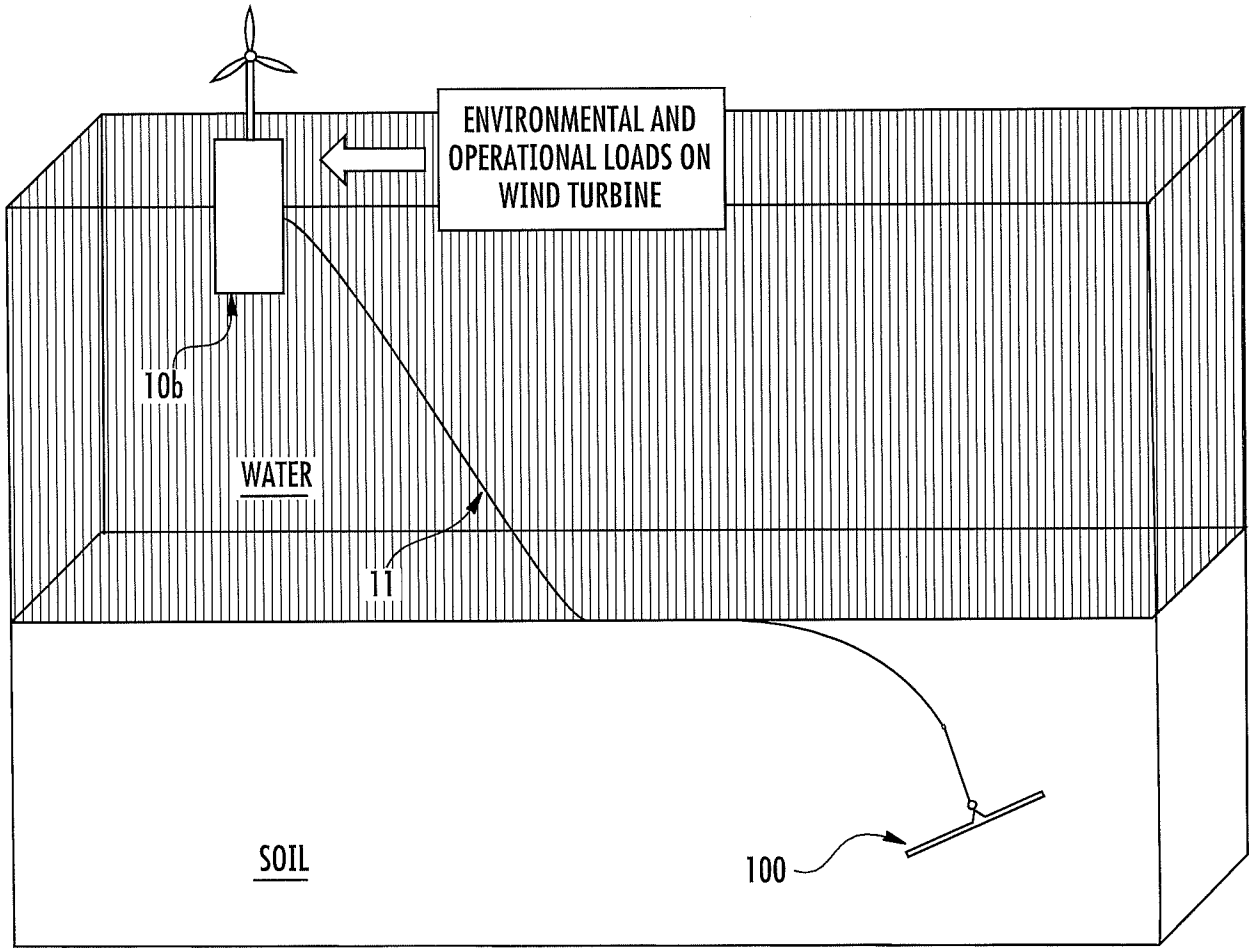
FIG. 9 is a side view of the anchor in FIG. 1 when the shank has reached alignment with the force from the anchor line and the force is again being transmitted to the fluke, making it dive deeper into the soil.
Figure 10:
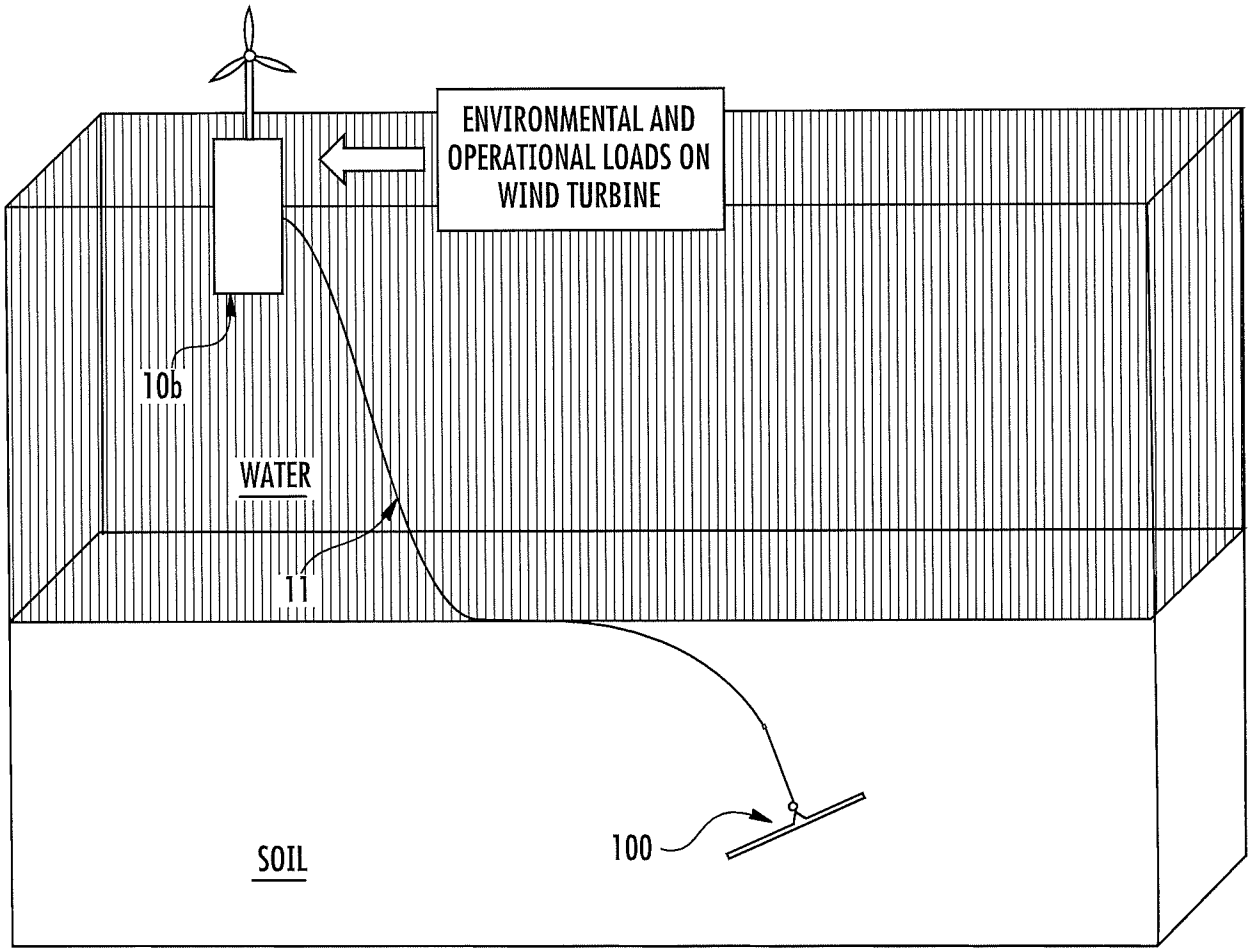
FIG. 10 is a side view of the anchor in FIG. 1 when the shank is in a fully extended position such that the anchor line extends normal to the fluke, and the maximum capacity of the anchor is attained.

FIG. 8 illustrates the shank during its rotation when the fluke is not moving. FIG. 9 illustrates the shank after it has reached alignment with the force from the anchor line 11. At this point, the force is again transmitted to the fluke, making the fluke dive deeper into the soil. In FIG. 10, the shank is in a fully extended position such that the anchor line 11 extends normal to the fluke. In this position, the maximum capacity of the anchor is attained.

Figure 11:
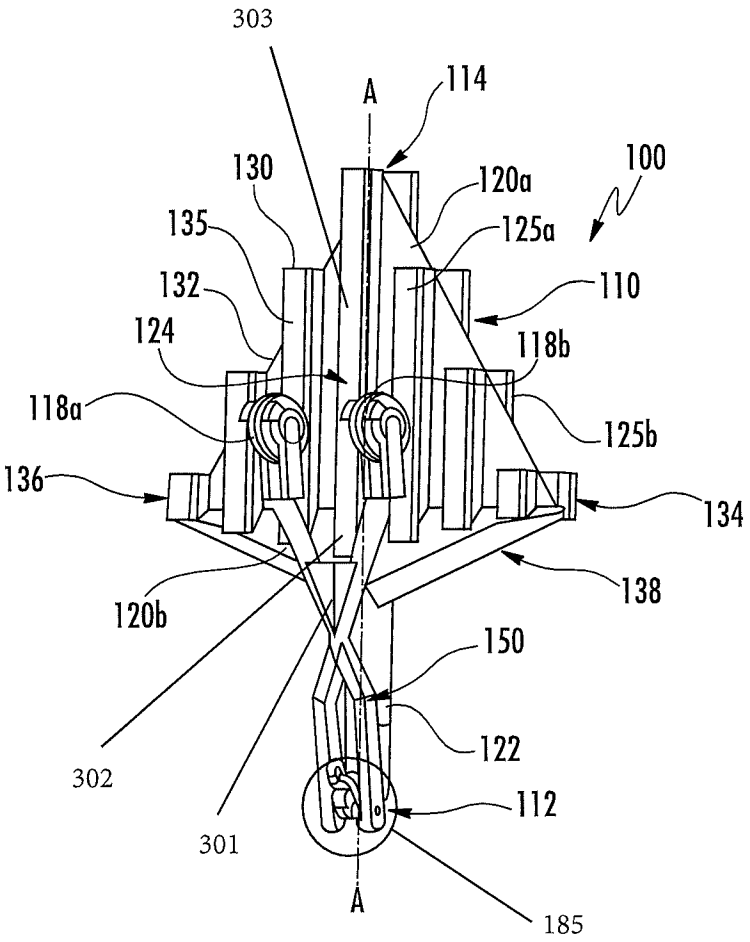
FIG. 11 is a perspective front view of an anchor in the installation configuration according to one implementation.
Figure 12:
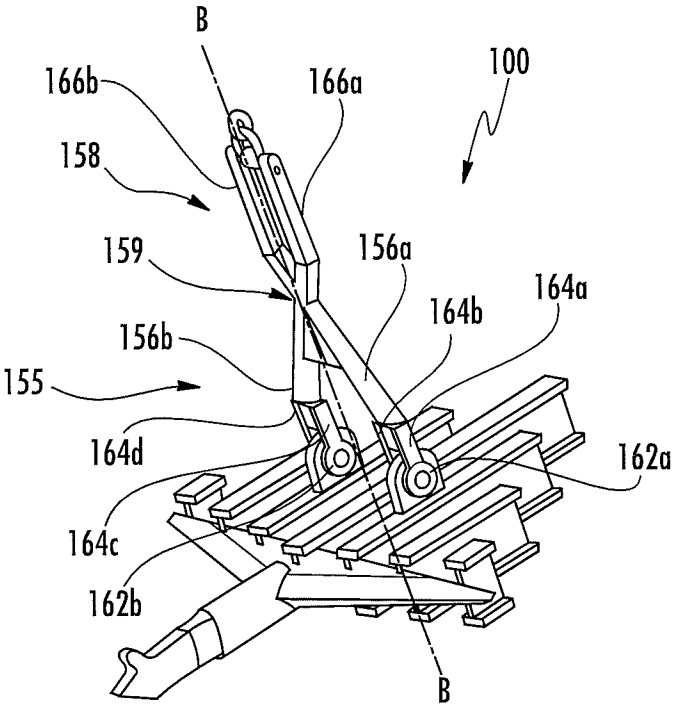
FIG. 12 is a perspective front view of the anchor of FIG. 11 in the final holding arrangement.
Figure 13:
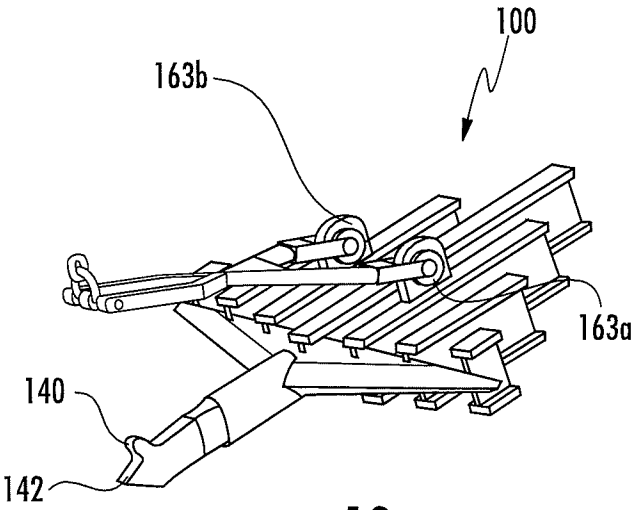
FIG. 13 is a perspective front view of the anchor of FIG. 11 between the installation and final holding arrangements.

FIGS. 11-13 provide close up views of anchor 100, according to one implementation. In particular, FIG. 11 illustrates the anchor 100 in a closed configuration in which both ends of the shank 150 are coupled to the fluke 110. The fluke 110 includes an entry end 112, a trailing end 114, a triangular-shaped upper base 120*a* and a triangular-shaped lower base 120*b* (as viewed from the front of the anchor 100), an arm 122 extending between the lower base 120*b* and the entry end 112, and hinge bosses 118*a*, 118*b* disposed adjacent the upper base 120*a* on a front face 124 of the fluke 110. A central axis A-A extends through the entry end 112, the trailing end 114, the arm 122, and the bases 120*a*, 120*b*.

A first plurality of elongated, T-shaped protrusions 125*a* extend normal from the upper base 120*a* away from the front face 124, and a second plurality of elongated, T-shaped protrusions 125*b* extend normal from the upper base 120*a* away from a rear face. Pairs of elongated, T-shaped protrusions 125*a*, 125*b* that extend outwardly from each of the front face 124 and the rear face of the upper base 120*a* are aligned with each other to form an I-shaped cross-section as viewed from the trailing end 114 of the anchor 100. Furthermore, distal ends 130 of each elongated, T-shaped protrusion 125*a*, 125*b* adjacent an outer perimeter 132 of the upper base 120*a* taper downwardly from the axis A-A to each side 134, 136 of the fluke 110 to follow the triangular perimeter of the upper base 120*a*. The distal ends 130 of the T-shaped protrusions 125*a*, 125*b* and a lower edge 138 of the lower base 120*b* define a diamond shape as viewed from the front 124 or rear face.

In the implementation shown in FIGS. 11-13, each hinge boss 118*a*, 118*b* is coupled to a distal face 135 of one of two T-shaped protrusions 125*a*. However, in other implementations (not shown), the hinges 118*a*, 118*b* may be coupled to the front face 124 of the upper base 120*a*.

The lower base 120 *b* is triangular shaped as viewed from the front face 124 or rear face of the fluke 110. A first edge of the triangle is adjacent the upper base 120 *a*, and second and third edges extend from the first edge to form an apex along a leading surface (facing the entry end 112) of the lower base 120 *b*. In addition, the front 124 and rear faces of the lower base 120 *b* taper toward each other along the second and third edges to form a hydrodynamic profile along the leading edge of the lower base 120 *b*. The front faces of the upper and lower bases 120 *a* and 120 *b* are the components that provide the bearing area to generate the holding capacity of the anchor 100. The lift force generated by the flow of the water on upper and lower bases 120 *a* and 120 *b* while the anchor is free falling is applied approximately at the center of lift 302, which is adjacent the junction between both bases, 120 *a* and 120 *b*. To provide hydrodynamic stability, the center of mass 301 has to be below this junction and the center of drag 303. To achieve this arrangement, the lower base 120 *b* may be a bulkier piece of steel than the upper base 120 *a*, the upper base 120 *a* may be a structurally optimized thin plate of steel, reinforced with the T-shaped protrusions 125 *a*, 125 *b*, for example, and the arm 122 extends downwardly between the lower base 120 *b* and the entry end 112 to add weight in the lower portion of the anchor 100. Also, the arm extends downwardly to provide additional eccentricity of the force applied by the anchor line 11 with respect to the center of the bearing area of the anchor 100 while the anchor 100 is rotating after embedding in the soil and prior to the triggering, or disengagement, of the coupling mechanism.

The various components of the fluke 110 may be formed of steel, for example. However, other materials may be used that are suitable for the application of the anchor 100, such as materials that have sufficient strength to prevent cracking or breaking after installation in the soil below the water. For example, the fluke 110 may comprise a combination of steel in the lower base 120 *b* and in the T-shaped protrusions 125 *a*, 125 *b* and a lightweight material, such as carbon fiber, in the upper base 120 *a*. Building the upper base 120 *a* and the upper part of the T-shaped protrusions 125 *a*, 125 *b*, which are components above the center of lift 302, with low weight, high strength materials as resins, carbon fiber, fiberglass, or similar provide a lower center of mass, reduce the size of the lower base 120 *b* and the arm 122, reduce the overall weight of the anchor 100, and may allow for a more efficient design.

In addition, the hinge bosses 118*a*, 118*b*, T-shaped protrusions 125*a*, 125*b*, lower base 120*b*, upper base 120*a*, and arm 122 may be integrally molded together. However, in other implementations, one or more of these features may be separately formed from the other features and coupled to the fluke 110 using suitable fastening mechanisms (e.g., welding or mechanical fasteners, such as bolts, screws, etc.).

The shank 150 includes an upper portion 155 and a lower portion 158 that are coupled together via a central portion 159. The upper portion 155, lower portion 158, and central portion 159 are aligned along an axis B-B. The upper portion 155 includes two arms 156*a*, 156*b* that extend away in the axial direction from the central portion 159. Distal ends of each arm 156*a*, 156*b* define at least one opening through which a pin (or other suitable fastener) may be engaged to secure the arms 156*a*, 156*b* to the hinge bosses 118*a*, 118*b*, respectively, such that the arms 156*a*, 156*b* may rotate about the pins. In the implementation shown in FIGS. 11-13, the openings in the distal ends of each arm 156*a*, 156*b* align with openings defined in the hinge bosses 118*a*, 118*b*, and a pin 162*a*, 162*b* engages the respective openings to rotatably couple the arms 156*a*, 156*b* to the hinge bosses 118*a*, 118*b*. A washer 163*a*, 163*b* (or other planar bearing structure) may be disposed between the openings of the arms 156*a*, 156*b* and the openings of the hinges 118*a*, 118*b* to support the rotational movement of the arms 156*a*, 156*b* relative to the hinge bosses 118*a*, 118*b* when the shank 150 is moving toward its open position.

In addition, in the implementation shown in FIGS. 11-13, each distal end of each arm 156*a*, 156*b* includes two spaced apart arms 164*a*, 164*b*, 164*c*, 164*d* that define the openings that are coupled to the hinge bosses 118*a*, 118*b*. Each set of spaced apart arms 164*a*, 164*b* and 164*c*, 164*d* is spaced apart a length that is at least as wide as the hinge boss 118*a*, 118*b*, respectively, to which the pair is coupled. However, in other implementations, each distal end of each arm 156*a*, 156*b* may define the openings without having the additional pairs of spaced arms 164*a*, 164*b*, 164*c*, 164*d*.

Figure 17:
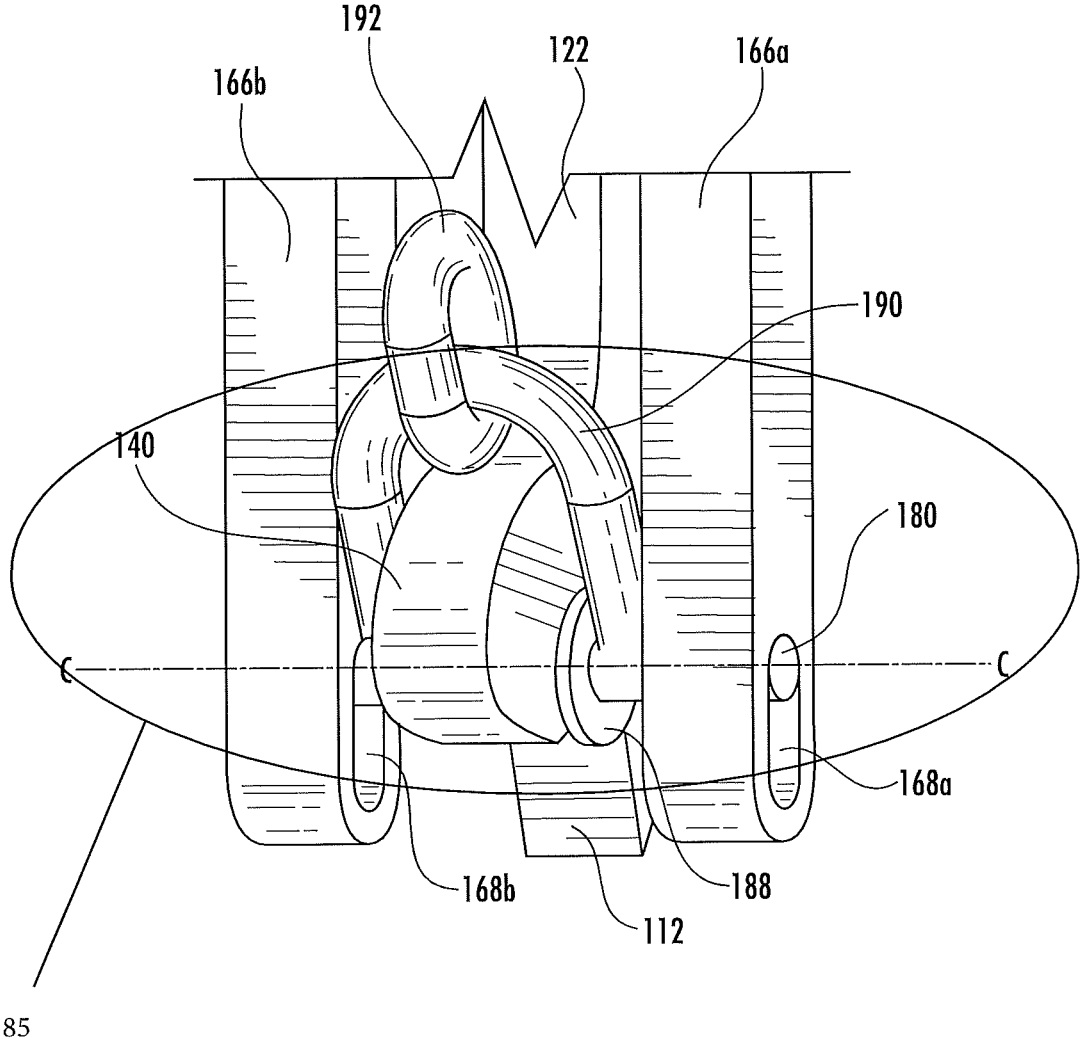
FIG. 17 is a close up perspective front view of the entry end of the anchor, the proximal end of the shank, the coupling mechanism, the protrusion, and a bearing surface in the installation configuration of the implementations shown in FIGS. 11 through 16.

FIG. 17 illustrates a close up view of the coupling mechanism that allows anchor 100, after pitching into the soil, to drastically change the eccentricity of the force being applied by the anchor line 11 to the fluke 110 by allowing the shank 150 to disengage from the fluke 110 at a predetermined angle. At first, the large eccentricity of the aforementioned force causes the anchor 100 to rotate within the soil. Then, after the shank 150 is liberated, the eccentricity changes direction and reduces its magnitude drastically, causing the anchor 100 to dive deeper into the soil.

Anchor 100 includes a protrusion 140 that extends away from the arm 122 of the fluke 110 in a direction extending outwardly from the front face 124, of the fluke 110. In particular, as viewed from the left side 134 of the fluke 110, the protrusion 140 extends outwardly from the arm 122 in a plane that is perpendicular to the front face 124. The protrusion 140 includes a hook shaped distal end that defines an inner arcuate shaped bearing surface 142 that faces towards the entry end 112 of the fluke 110. An axis C-C extends through the geometric center of the arcuate shaped bearing surface 142 and is perpendicular to axis B-B that extends through each end of the shank 150.

The entry end 112, of the fluke 110, is tapered to a point, as viewed from the side 134, 136 of the fluke 110, to create less drag as the anchor 100 drops through the water and less friction as it penetrates the soil. The protrusion 140 may be integrally molded with the arm 122 or separately formed and attached thereto using suitable fastening mechanisms.

Figure 18:
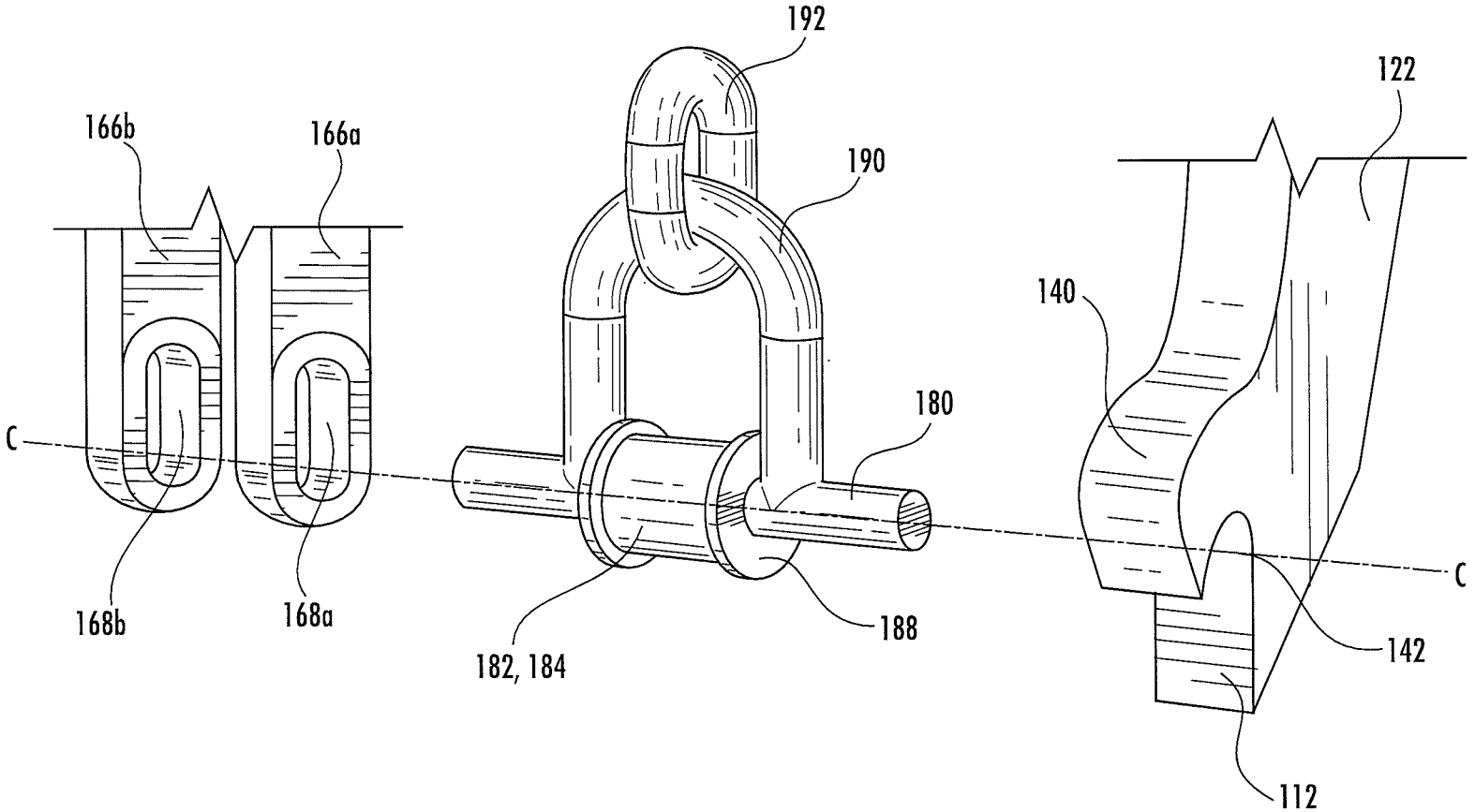
FIG. 18 is an exploded view of the entry end of the anchor, the proximal end of the shank, the coupling mechanism, the protrusion, and the bearing surface of the implementation shown in FIG. 17.

The lower portion 158 of shank 150 includes two arms 166*a*, 166*b* that extend away from the central portion 159. As shown in FIGS. 17 and 18, each distal end of each arm 166*a*, 166*b* defines an elongated slot 168*a*, 168*b*, respectively, that has a length and width. The length is measured in the direction of the axis B-B, and the width is measured in a direction normal to axis B-B and axis C-C. The length of each slot 168*a*, 168*b* is larger than the width, and the slots 168*a*, 168*b* are aligned horizontally.

Figure 19:
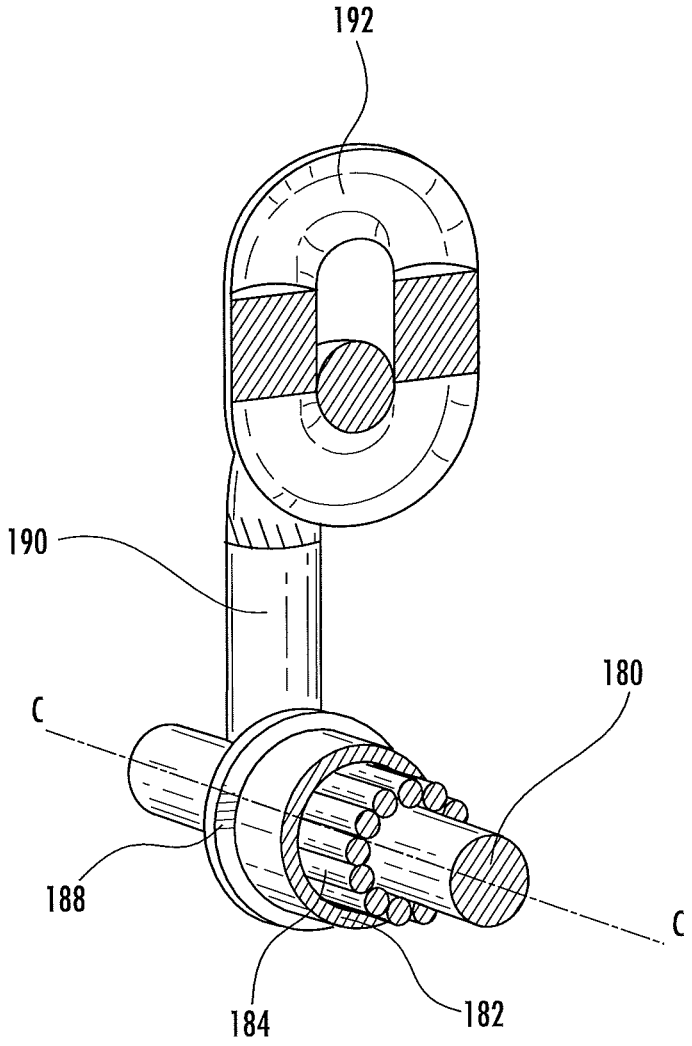
FIG. 19 is a partial cut out view of the coupling mechanism shown in FIG. 18.

The anchor line 11, which ends at link 192, is attached to shank 150 by a coupling mechanism 185, which can be seen by itself in FIG. 18, and in a partial cut view in FIG. 19. The coupling mechanism 185 includes a U-shaped hook 190, a pin 180, and a spool 182. Spool 182 has a greater diameter than the pin 180, is collinear to pin 180, and is installed around it. Spool 182 freely rotates around pin 180 via roller bearings 184 disposed between an outer surface of pin 180 and an inner surface of spool 182.

Pin 180 extends through the slots 168*a*, 168*b*. The diameter of the pin 180 is less than the width of the slots 168*a*, 168*b* to allow the pin 180 to rotate and move along axis B-B within the slots 168*a*, 168*b*. In addition, the shank coupling mechanism 185 includes annular rims 188 adjacent each side of the spool 182 that have a diameter greater than the central portion of the spool 182. The central portion of the spool 182 extends between the annular rims 188. The annular rims 188 keep spool 182 centered relative to the protrusion 140.

Distal ends of a U-shaped hook 190 are fixed to the pin 180 adjacent outer (or distal) sides of the rims 188, and a link 192 is coupled adjacent a central portion of the hook 190. The link 192 is free to move independently of the hook 190, but movement of the hook 190 moves the pin 180 since they are fixedly coupled together. In alternative implementations, the spool 182 may not include annular rims 188.

Figure 20A:
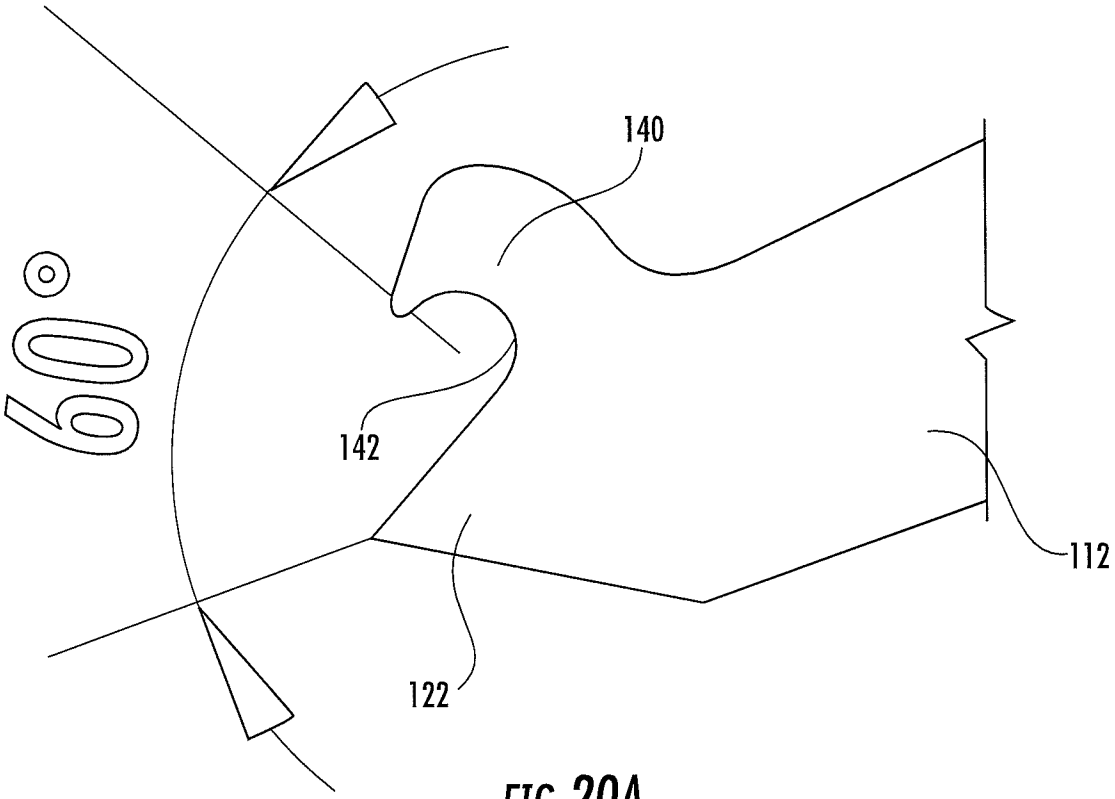
FIG. 20A is a lateral view of the bearing surface shown in FIG. 18, presenting, as an example, a threshold angle at which the coupling mechanism would be disengaged.

FIG. 20A presents a lateral view of arm 122, entry end 112 and protrusion 140, showing, as an example, the threshold angle of about 30 degrees between the normal to axis A-A and the force being applied by the anchor line 11 at which the shank coupling mechanism 185 would be triggered, as the bearing surface 142 ends at that threshold angle.

Figure 20B:
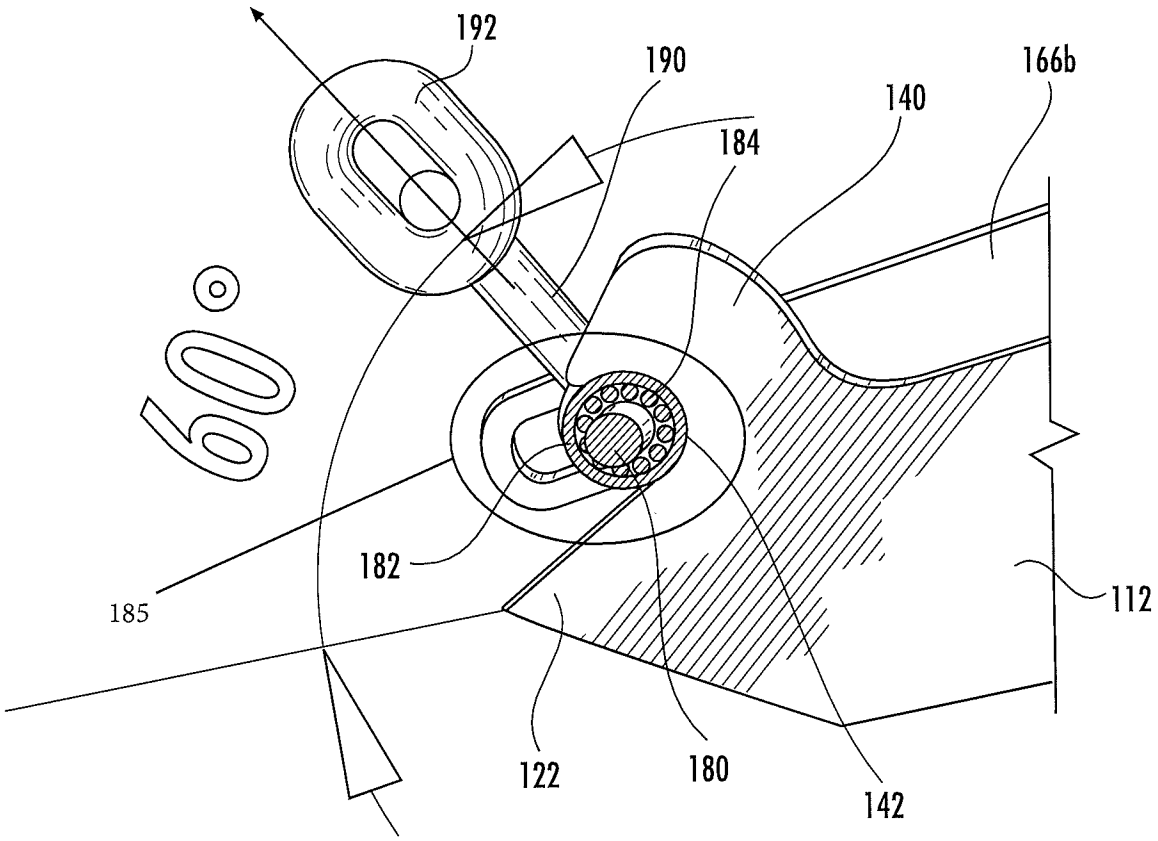
FIG. 20B is a partial cut view of the entry end of the anchor, the proximal end of the shank, the coupling mechanism, the protrusion, and the bearing surface of the implementation shown in FIG. 17, when the force applied by the anchor line through the disengaging mechanism has reached the threshold angle.
Figure 20C:
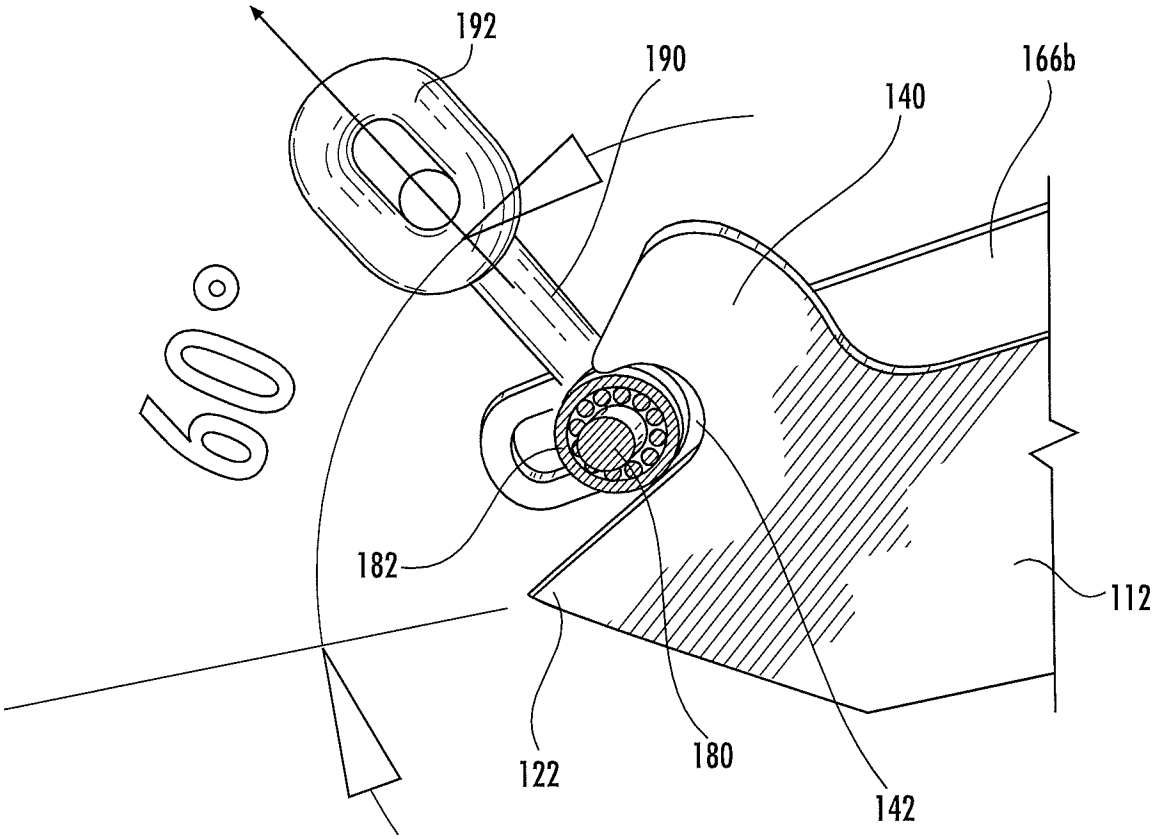
FIG. 20C is a partial cut view of the entry end of the anchor, the proximal end of the shank, the coupling mechanism, the protrusion, and the bearing surface shown in FIG. 17, when the force applied by the anchor line through the coupling mechanism has exceeded the threshold angle and the coupling mechanism is disengaging from the bearing surface.
Figure 21:
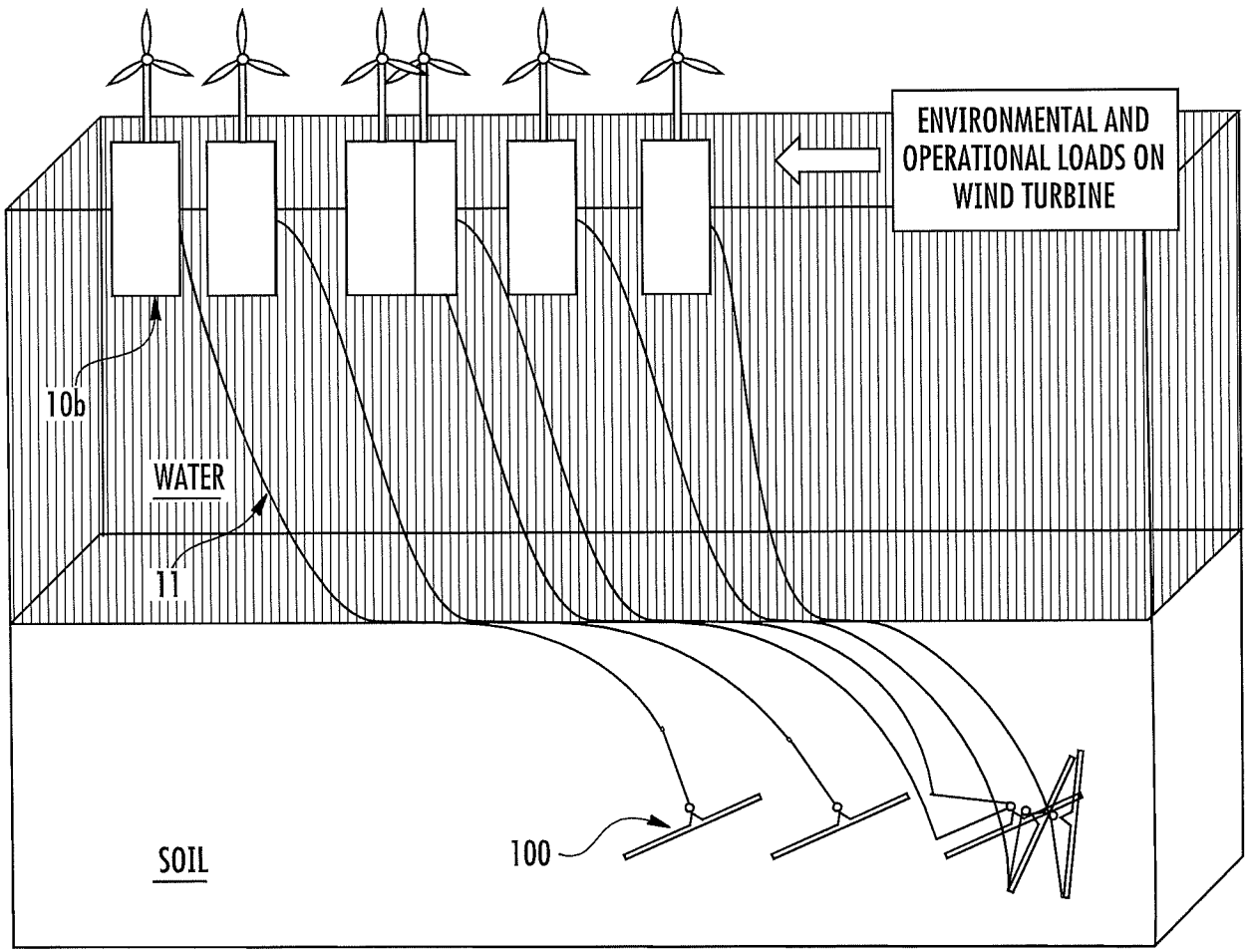
FIG. 21 is a side view of the various positions shown in FIGS. 5-10 of the anchor during installation.

FIG. 20B shows the lateral view of FIG. 20A including a cut view of the coupling mechanism 185 at the point where the force has reached the threshold angle and further rotation of the anchor 100 is not possible. FIG. 20C shows the same elements as FIG. 20B when the angle between the force being applied by the anchor line 11 and the anchor 100 has gone beyond the threshold value, and the coupling mechanism 185 is disengaging the bearing surface 142.

Figure 14:
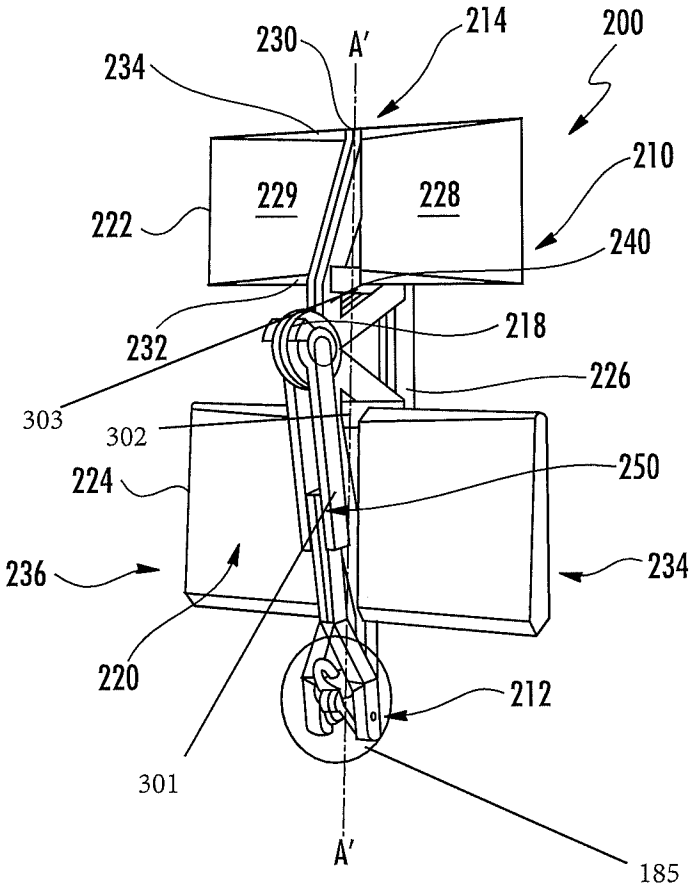
FIG. 14 is a perspective front view of an anchor in an installation arrangement according to another implementation.

For installation of the anchor 100 into the soil below the water, the anchor line 11 is attached to the link 192, and the spool 182 is engaged against the bearing surface 142 of protrusion 140. In this closed position, which is shown in FIGS. 11 and 14, the shank 150 is close to or substantially parallel with a central plane of the fluke 110 that contains axis A-A and extends through the arm 122, the bases 120*a*, 120*b*, and each side 134, 136 of the fluke 110. The anchor 100 is dropped into the water with the entry end 112 facing the soil. After dropping the anchor 100, it gets minimal or no resistance from anchor line 11, which is reeled out, to allow the anchor 100 to gain speed. Slight resistance of the reeling process in vessel 10*a* and drag on the anchor line 11 urge the spool 182 to engage against the bearing surface 142.

The anchor 100 enters the soil under its own weight and momentum from falling through the water. Frictional resistance from the soil slows the vertical movement of the anchor 100 to the point of stopping it. Anchor 100 remains static, embedded into the soil, in the same vertical position as while free falling thru the water. Installation vessel 10*a* transfers anchor line 11 to the vessel 10*b* to be moored. Environmental and operational loads acting on the moored vessel 10*b* are transferred to the anchor line 11, which transfers the force first to the soil via friction and then to the anchor 100. When the force being transmitted to anchor 100 reaches a threshold value, dependent on the soil characteristics and the anchor geometry, anchor 100 begins to pitch, as can be seen in FIG. 6.

As the load on anchor line 11 increases, the pitch increases and the angle between a horizontal plane and a plane containing anchor 100 decreases. Also, as the load on anchor line 11 increases, the angle between a horizontal plane and the force applied to anchor 100 decreases, starting at close to about 90 degrees and never quite getting to 0 degrees. At a predetermined threshold angle between the force applied to the anchor 100 and axis A-A, which in FIG. 20A, as an example, is about 60 degrees, the coupling mechanism 185 is triggered and the spool 182 rotates away from bearing surface 142 as can be inferred from FIG. 20C. When the spool 182 rotates away from bearing surface 142, pin 180 travels along elongated slots 168*a*, 168*b*.

When the spool 182 has cleared protrusion 140 and pin 180 is disposed at the distal ends of the slots 168*a*, 168*b*, the load applied by anchor line 11 no longer gets transmitted to the fluke 110 through the arm 122. The anchor 100 as a whole stops pitching, and the shank 150 starts rotating about hinges 118*a*, 118*b*, as shown in FIGS. 7 and 8, until the axis B-B of the shank 150 is collinear with the force being applied by anchor line 11 at the upper end 155 as shown in FIG. 9. Having the force collinear with the axis B-B of the shank 150 makes the shank 150 stop turning and transfers the load to the fluke 110 through hinges 118*a*, 118*b*. At this point the eccentricity of the load applied to the fluke 110 has changed direction and diminished considerably, which makes the fluke 110 dive deeper into the soil as depicted in FIG. 9. As the anchor 100 is diving deeper into the soil, the anchor line 11 is traversing more, which causes the shank 150 to rotate further away from the fluke 110 and ultimately reach its final position where the force applied by the anchor line 11 and the axis B-B of shank 150 are almost perpendicular to the fluke 110 and the maximum holding capacity of the anchor is attained. This configuration is shown in FIGS. 10, 12, and 15.

Figure 15:
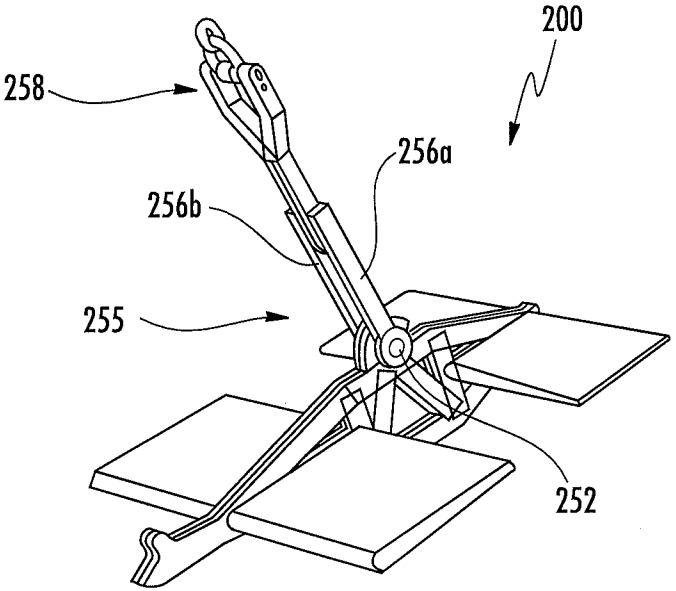
FIG. 15 is a perspective front view of the anchor in FIG. 14 in the final holding arrangement.
Figure 16:
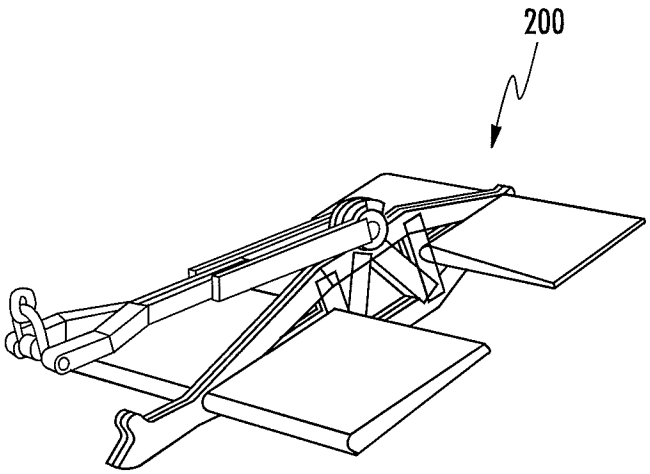
FIG. 16 is a perspective front view of the anchor of FIG. 14 between the installation and holding arrangements.

FIGS. 14-16 illustrate an anchor 200 according to an alternative implementation. The structure of the fluke 210, the hinge 218 disposed on the fluke 210, and the upper portion 255 of the shank 250 are different from those described above in relation to anchor 100, but the other features are similar to that of anchor 100. In addition, the overall behavior during installation and operation, as well as the performance of the anchors 100, 200 are similar.

The fluke 210 of anchor 200 includes two wings 222, 224 that are coupled to a central frame 226 of the fluke 210. The wings 222, 224 have a rectangular shaped cross-section as viewed from a front face 220 of the fluke 210. Wing 224 is disposed adjacent entry end 212 and has an airfoil shaped cross-section as viewed from the sides 234, 236 of the fluke 210. Wing 224 is oriented such that the leading edge of wing 224 faces toward the entry end 212 of the fluke 210, and the trailing edge of the wing 224 faces toward the trailing end 214. Wing 224 is thicker than wing 222 in order to bring the center of mass of the anchor 200 towards the entry end 212.

Wing 222 is composed of sides 228 and 229, each acting as a cantilever when deployed in the soil. Components 228 and 229 have a hexagonal cross section as viewed from the sides 234 and 236 of the fluke 210. For structural reasons, the aforementioned cross section has a maximal thickness adjacent to frame 226 which tapers away from frame 226 in order to optimize the weight and make the portion of anchor 200 which is above the center of lift as light as possible. Wing 222 is disposed adjacent the trailing end 214 of the fluke 210.

The frame 226 has a central portion 240 that extends between the leading edge of wing 222 and the trailing edge of wing 224. The central portion 240 includes a hinge 218 that extends outwardly from the central portion 240 in a direction away from the front face 220 of the fluke 210. The hinge 218 defines an opening extending horizontally through it.

Axis A'-A' extends between the entry end 212 and the trailing end 214. The leading and trailing edges and faces of wings 222, 224, respectively, are substantially parallel. The central portion 240 of the frame 226 extends normally from the axis A'-A' away from the front 220 and rear faces of the fluke 210, forming a truss that provides structural support to frame 226 to prevent it from flexing, overstress, or failure.

An upper portion 255 of shank 250 includes two arms 256*a*, 256*b* that each define an opening adjacent a distal end of each arm 256*a*, 256*b*. The opening of the hinge 218 and the openings of the arms 256*a*, 256*b* are aligned, and a pin 252 or other suitable fastener is engaged through the openings to rotatably couple the arms 256*a*, 256*b* to the hinge 218. The shank 250 may rotate about the axis extending through the pin 252.

However, in other implementations, the fluke may include any suitably shaped anchor (e.g., any planar geometry, such as triangular, square, round, etc.) that provides a center of mass below the center of lift and center of drag while the anchor is falling through the water. In addition, other suitable coupling mechanisms may be used that allow for the change in eccentricity that causes the anchor to rotate in the soil until the coupling mechanism disengages from the fluke and allows the anchor to dive deeper into the soil. The diving behavior of the anchor depends, at least in part, on the surface area of the front face of the fluke and the distance from the front face of the fluke to the point at which the shank attaches to the hinges. Thus, the surface area and/or the distance between the front face of the fluke and the hinge attachment point may vary so long as the combination of anchor features allows for the aforementioned diving behavior.

Furthermore, although the flukes 110, 210 described above have a specific shape, other hydro-dynamically shaped flukes may be used in accordance with various implementations of the invention. In particular, flukes that provide a center of mass below the center of lift and the center of drag allows the anchor to drop straight down in the water or restore itself to vertical if perturbed. This feature allows the anchor to be installed without additional or sacrificial weight and without the use of additional equipment or vessels. The weight of the anchor is sufficient to contribute to the free-fall penetration through the water and soil. Furthermore, alternative coupling mechanisms, such as a pendulum, magnet, or an electronic switch, may be used to engage the lower end of the shank adjacent the entry end of the fluke for free fall through the water and initially into the soil and disengage the lower end of the shank when the load causes the angle of the line relative to the fluke to reach a certain threshold angle (e.g., about 60 degrees).

In some implementations, an electromagnetic source is attached to the anchor, and the field generated by the source is used to track the location, depth, and orientation of the anchor during installation and service. Such implementations may be useful when the anchor is used to secure permanent or semi-permanent facilities, for example.

When it is loaded in service, the anchor pitches, dives deeper and ultimately provides the maximum possible holding capacity with the line pulling normal to the front face of the fluke of the anchor. This innovation of progressing from a vertical orientation to one with the line pulling close to or substantially normal to the fluke is achieved with a triggered hinge that holds the shank substantially parallel to the fluke until the angle between the line and the fluke exceeds the threshold angle.

Various modifications of the devices and methods in addition to those shown and described herein are intended to fall within the scope of the appended claims. Further, while only certain representative devices and method steps disclosed herein are specifically described, other combinations of the devices and method steps are intended to fall within the scope of the appended claims, even if not specifically recited. Thus, a combination of steps, elements, components, or constituents may be explicitly mentioned herein. However, other combinations of steps, elements, components, and constituents are included, even though not explicitly stated. The term "comprising" and variations thereof as used herein is used synonymously with the term "including" and variations thereof and are open, non-limiting terms.

The invention claimed is:

1. An anchor comprising:

a shank having first and second ends;

a fluke having an entry end, a trailing end, and a central portion intermediate the entry and trailing ends;

a bearing surface disposed adjacent the entry end of the fluke; and a pin disposed adjacent the second end of the shank, the (1) engaging the bearing surface of the fluke during passage of the anchor through water and while embedding vertically into the soil, (2) transmitting a force applied by an anchor line to a front surface of the fluke causing the anchor to pitch, and (3) disengaging the bearing surface when a threshold angle between the force applied by the anchor line and the fluke is attained, causing the anchor to translate near parallel to the fluke, wherein:

a first end of the shank is rotatably coupled adjacent a central area of the front surface of the fluke, when the pin is engaged with the bearing surface, a center of mass of the anchor is below a center of drag and a center of lift of the anchor to keep the anchor vertically oriented such that the entry end of the fluke is vertically below and aligned with the trailing end of the fluke while passing through water, and a weight of the anchor urges the anchor through the water and into soil below the water.

2. The anchor of claim 1, wherein at least a portion of the fluke is diamond shaped.

3. The anchor of claim 2, wherein the diamond shaped portion of the fluke is adjacent the trailing end.

4. The anchor of claim 3, wherein the fluke comprises a planar base and T-shaped protrusions, the T-shaped protrusions extend from a front face and a rear face of the base as viewed from the trailing end of the fluke.

5. The anchor of claim 1, wherein the trailing end of the fluke is triangular-shaped.

6. The anchor of claim 1, wherein the fluke comprises a first wing adjacent the trailing end of the fluke and a second wing disposed between the trailing end and the entry end of the fluke, wherein the second wing has a rectangular cross sectional shape as viewed from a front or a rear surface of the fluke and an airfoil cross-sectional shape as viewed from a side surface of the fluke.

7. The anchor of claim 1, wherein:

a protrusion extends outwardly from the front face of the fluke, wherein a proximal end of the protrusion is disposed adjacent the front face of the entry end of the fluke, and the bearing surface comprises a surface of the protrusion that faces the entry end of the fluke, and the shank further comprises:

two arms spaced apart from each other disposed at the second end of the shank, each of the two arms defining an elongated slot there through, wherein the elongated slots are aligned with each other along a first axis that extends through each arm and is perpendicular to a second axis extending through each end of the shank, and the elongated slots have the same slot width and length, and the pin is disposed between the two arms and extends through the elongated slots and is configured to move through the slots along the second axis, wherein a central portion of the pin engages the bearing surface to hold the second axis of the shank adjacent a third axis extending through each end of the fluke when the pin is disposed at proximal ends of the elongated slots, and the central portion of the pin disengages the bearing surface when the pin is disposed at distal ends of the elongated slots, allowing the second axis of the shank to rotate about the second end of the shank relative to the third axis of the fluke.

8. The anchor of claim 7, wherein the central portion of the pin comprises a spool extending radially outwardly from an axis extending through each end of the pin, the spool configured for rotating freely around the axis of the pin.

9. The anchor of claim 8, further comprising a U-shaped hook, wherein ends of the U-shaped hook are coupled to the pin adjacent each end of the spool.

10. The anchor of claim 9, further comprising a link coupled to the U-shaped hook, the link being configured for coupling to the anchor line.

11. The anchor of claim 7, further comprising a U-shaped hook, wherein ends of the U-shaped hook are coupled to the pin adjacent a central portion of the pin.

12. The anchor of claim 11, further comprising a link coupled to the U-shaped hook, the link being configured for coupling with a line, the line extending between the anchor and the vessel.

13. The anchor of claim 1, wherein the first end of the shank comprises first and second arms that are spaced apart from each other and are each rotatably coupled to the central portion of the fluke.

14. The anchor of claim 1, wherein the central portion of the pin comprises a spool extending radially outwardly from an axis extending through each end of the pin, the spool being freely rotatable around the axis of the pin, and the spool engaging the bearing surface of the fluke during passage of the anchor through the water and while embedding vertically into the soil and disengaging the bearing surface when the threshold angle between the force applied by the anchor line and the fluke is attained.

* * * * *